US007557785B2

(12) United States Patent
Kim

(10) Patent No.: US 7,557,785 B2
(45) Date of Patent: Jul. 7, 2009

(54) LIQUID CRYSTAL DISPLAY DEVICE AND DRIVING METHOD THEREOF

(75) Inventor: Woo Hyun Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 676 days.

(21) Appl. No.: 11/117,561

(22) Filed: Apr. 29, 2005

(65) Prior Publication Data

US 2005/0243045 A1 Nov. 3, 2005

(30) Foreign Application Priority Data

Apr. 30, 2004 (KR) ..... 10-2004-0030665

(51) Int. Cl.
*G09G 3/36* (2006.01)

(52) U.S. Cl. ..... 345/87; 345/102

(58) Field of Classification Search ..... 345/87–103, 345/208, 692

See application file for complete search history.

(56) References Cited

U.S. PATENT DOCUMENTS 5,952,989 A * 9/1999 Koyama ..... 345/92
6,075,505 A * 6/2000 Shiba et al. ..... 345/87
2006/0164363 A1 * 7/2006 Battersby et al. ..... 345/98

* cited by examiner

*Primary Examiner*—Alexander Eisen
*Assistant Examiner*—Kenneth B Lee, Jr.
(74) *Attorney, Agent, or Firm*—McKenna Long & Aldridge LLP

(57) ABSTRACT

A liquid crystal display device includes a liquid crystal display panel having a plurality of data lines; a plurality of gate lines crossing the data lines; first and second control lines parallel to the gate lines; first liquid crystal cells provided at one side of the data lines, respectively; second liquid crystal cells provided at another side of the data lines, respectively; a first switching part that drives the first liquid crystal cells, the first switching part being controlled by the first control line and the gate line; a second switching part that drives the second liquid crystal cells, the second switching part being controlled by the second control line and the gate line; and a liquid crystal display panel driver that supplies pixel voltage signals having the same polarity to the first and second liquid crystal cells positioned between adjacent i-numbered data lines and (i+1)-numbered data lines.

13 Claims, 23 Drawing Sheets

LIQUID CRYSTAL DISPLAY DEVICE AND DRIVING METHOD THEREOF

This application claims the benefit of Korean Patent Application No. P2004-30665 filed in Korea on Apr. 30, 2004, which is hereby incorporated by reference.

BACKGROUND OF THE INVENTION

1. Field of the Invention

This invention relates to a liquid crystal display, and more particularly to a liquid crystal display device and a driving method thereof.

2. Description of the Related Art

Generally, a liquid crystal display (LCD) controls the light transmittance of liquid crystal using an electric field, to thereby display a picture. To this end, the LCD includes a liquid crystal display panel having a pixel matrix, and a driving circuit for driving the liquid crystal display panel. The driving circuit drives the pixel matrix such that picture information can be displayed on the display panel.

FIG. 1 is a block circuit diagram of a liquid crystal display according to a related art. Referring to FIG. 1, the related art LCD includes a liquid crystal display panel 2, a data driver 4 for driving data lines DL1 to DLm of the liquid crystal display panel 2, and a gate driver 6 for driving gate lines GL1 to GLn of the liquid crystal display panel 2. The liquid crystal display panel 2 includes thin film transistors (TFT), each of which is provided at each crossing of the gate lines GL1 to GLn and the data lines DL1 to DLm. Liquid crystal cells are electrically connected to the TFTs and are arranged to form a matrix.

The gate driver 6 sequentially applies a gate signal to each gate line GL1 to GLn in response to a control signal from a timing controller (not shown). The data driver 4 converts R, G and B data from the timing controller into analog video signal to thereby apply video signals for one horizontal line to the data lines DL1 to DLm during each horizontal period when a gate signal is applied to each gate line GL1 to GLn.

The TFT applies a data from the data lines DL1 to DLm to the liquid crystal cell in response to a control signal from the gate lines GL1 to GLn. The liquid crystal cell can be represented by a liquid crystal capacitor Clc because it includes a common electrode and a pixel electrode facing each other and having liquid crystal between them. The pixel electrode is connected to the TFT. The liquid crystal cell includes a storage capacitor (not shown) connected to a pre-stage gate line in order to keep a data voltage charged in the liquid crystal capacitor Clc until the next data voltage is charged therein.

The number of vertical lines formed by the liquid crystal cells in the related art LCD is equal to the number (i.e., m) of the data lines DL1 to DLm because they are provided at crossings of the gate lines GL1 to GLn and the data lines DL1 to DLm. In other words, the liquid crystal cells are arranged in a matrix to form an m-number of vertical lines and an n-number of horizontal lines.

The related art LCD requires m data lines DL1 to DLm to drive the liquid crystal cells having m vertical lines. Thus, the related art LCD requires m/i data driver integrated circuits (wherein "i" is the number of data output lines provided by one data integrated circuit) in order to drive the m-number of data lines. Therefore, as a resolution of the LCD increases, the number of data drivers integrated circuits, which are costly, increases. Moreover, process time for attaching the driver integrated circuit and manufacturing cost of the LCD also increases.

SUMMARY OF THE INVENTION

Accordingly, the present invention is directed to a liquid crystal display device and a method of driving the same that substantially obviates one or more problems due to limitations and disadvantages of the related art.

An object of the present invention is to provide an LCD device having a reduced number of data drivers.

Another object of the present invention is to provide a method of driving an LCD device with a reduced number of data lines.

Another object of the present invention is to provide a method of driving an LCD device at a reduced manufacturing cost.

Additional features and advantages of the invention will be set forth in part in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, a liquid crystal display device includes a liquid crystal display panel having a plurality of data lines; a plurality of gate lines crossing the data lines; first and second control lines parallel to the gate lines; first liquid crystal cells provided at one side of the data lines, respectively; second liquid crystal cells provided at another side of the data lines, respectively; a first switching part that drives the first liquid crystal cells, the first switching part being controlled by the first control line and the gate line; a second switching part that drives the second liquid crystal cells, the second switching part being controlled by the second control line and the gate line; and a liquid crystal display panel driver that supplies pixel voltage signals having the same polarity to the first and second liquid crystal cells positioned between adjacent i-numbered data lines and (i+1)-numbered data lines.

In another aspect, a method of driving a liquid crystal display device, which includes a liquid crystal display panel having a plurality of data lines, a plurality of gate lines crossing the data lines, first and second control lines being parallel to the gate lines, first liquid crystal cells provided at one side of the data lines, respectively, second liquid crystal cells provided at another side of the data lines, respectively, a first switching part for driving the first liquid crystal cells under control of the first control line and the gate line, and a second switching part for driving the second liquid crystal cells under control of the second control line and the gate line, includes supplying first pixel signals to the first liquid crystal cells during a first half-frame period; and supplying second pixel signals to the second liquid crystal cells during a second half-frame period, the second pixel signals having the same polarity as the first pixel signals.

In another aspect, a thin film transistor array substrate for a liquid crystal display panel includes a plurality of gate lines provided on a lower substrate; first and second control lines positioned at opposite sides of each of the plurality of the gate lines; data lines crossing the first and second control lines; first and second liquid crystal cells alternately provided at each crossing of the gate lines and the data lines; a plurality of first switching parts for driving the first liquid crystal cells, each of the first switching parts being provided at the right side of a respective one of the data lines; a plurality of second switching parts for driving the second liquid crystal cells, each of the second switching parts being provided at the left side of the respective one of the data lines; and means for supplying a first pixel voltage signal to the first liquid crystal cells, and a second pixel voltage signal to the second liquid crystal cells, the first pixel voltage signal and the second voltage signal having same polarity.

It is to be understood that both the foregoing general description and the following detailed description are exemplary and explanatory and are intended to provide further explanation of the invention as claimed.

BRIEF DESCRIPTION OF THE DRAWINGS

These and other objects of the invention will be apparent from the following detailed description of the embodiments of the present invention with reference to the accompanying drawings.

DETAILED DESCRIPTION OF THE PREFERRED EMBODIMENT

Reference will now be made in detail to the preferred embodiments of the present invention, examples of which are illustrated in the accompanying drawings. Hereinafter, the preferred embodiments of the present invention will be described in detail with reference to FIGS. 2 to 12C.

Figure 2:
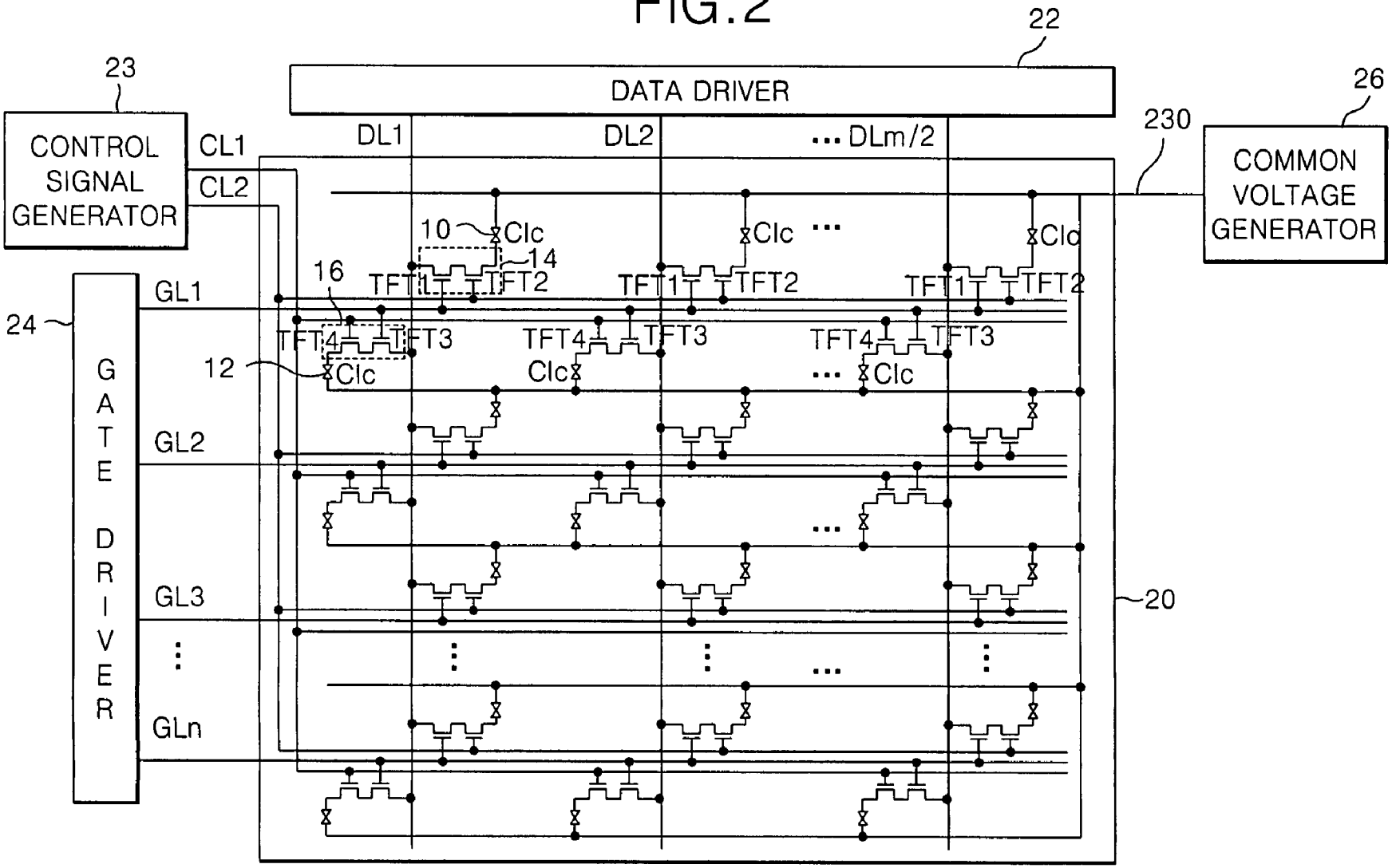
FIG. 2 is a block circuit diagram of an exemplary liquid crystal display according to an embodiment of the present invention.

FIG. 2 is a block circuit diagram of an exemplary liquid crystal display according to an embodiment of the present invention. Referring to FIG. 2, the LCD includes a liquid crystal display panel 20, a data driver 22, a gate driver 24, a control signal generator 23, and a common voltage generator 26. The data driver 22 drives data lines DL1 to DLm/2 of the liquid crystal display panel 20. The gate driver 24 drives gate lines GL1 to GLn of the liquid crystal display panel 20. The control signal generator 23 supplies control signals to first and second control lines CL1 and CL2 provided in parallel to the gate lines GL1 to GLn. The common voltage generator drives common lines 230.

The liquid crystal display panel 20 also includes a thin film transistor array substrate (not shown) and a color filter array substrate (not shown) facing each other. Liquid crystal is provided between the thin film transistor array substrate and the color filter array substrate.

The gate driver 24 sequentially applies a gate signal SP to the gate lines GL1 to GLn for each ½ frame period in response to a control signal provided by a timing controller (not shown). Thus, the gate driver 24 drives each of the gate lines GL1 to GLn for a period of ½ frame.

The data driver 22 converts R, G and B data received from the timing controller into analog video signals. The data driver 22 applies the converted analog video signals to the data lines DL1 to DLm/2. During each ½ frame period, the data driver 22 alternately applies a pixel signal to a first liquid crystal cell 10 and a second liquid crystal cell 12 depending on the polarity of the pixel signal.

The data driver 22 uses a dot inversion system to differentiate between the polarity of the pixel signal corresponding to the first liquid crystal cell 10 in the first-half ½ frame, and the polarity of the pixel signal corresponding to the second liquid crystal cell 12 in the second-half ½ frame period. Further, the data driver 22 applies pixel signals having the same polarity to the first and second liquid crystal cells 10 and 12 positioned between the ith data line DLi and the (i+1)th data line DLi+1.

Figure 3:
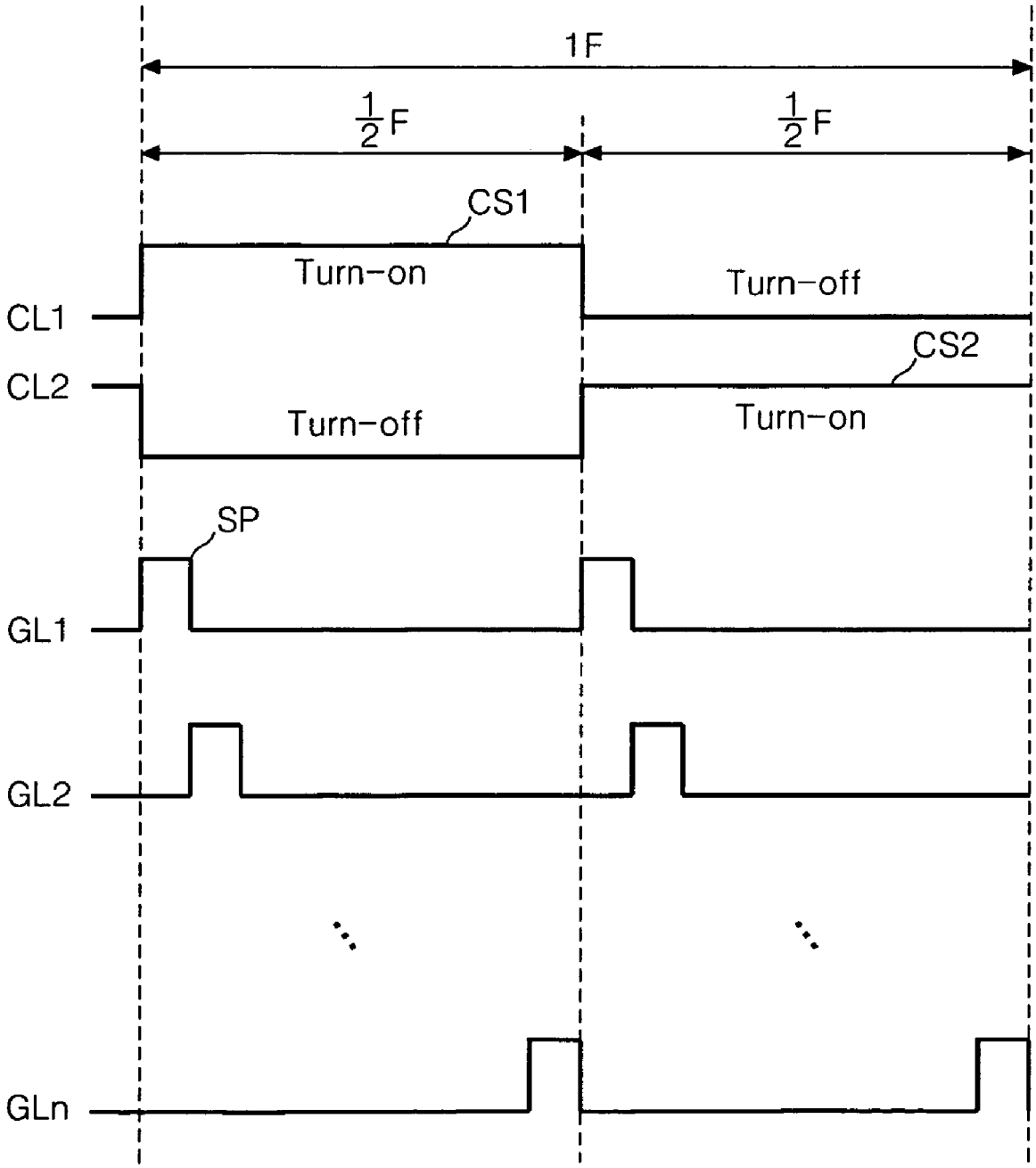
FIG. 3 is a waveform diagram for a plurality of control signals and gate signals according to an embodiment of the present invention.

FIG. 3 is a waveform diagram for a plurality of control signals and gate signals according to an embodiment of the present invention. Referring to FIG. 2 and FIG. 3, the control signal generator 23 alternately supplies first and second control signals CS1 and CS2 to the first and second control lines CL1 and CL2, respectively, during each ½ frame period. For example, the control signal generator 23 can supply the first control signal CS1 to the first control line CL1 during the first half-frame period, and supply the second control signal CS2 to the second control line CL2 during the second half-frame period. Alternatively, the control signal generator 23 can supply the second control signal CS2 to the second control line CL2 during the first half-frame period, and supply the first control signal CS1 to the first control line CL1 during the second half-frame period. Moreover, the LCD can supply the first and second control signals CS1 and CS2 directly from the timing controller without the intermediary of the control signal generator 23.

Figure 4:
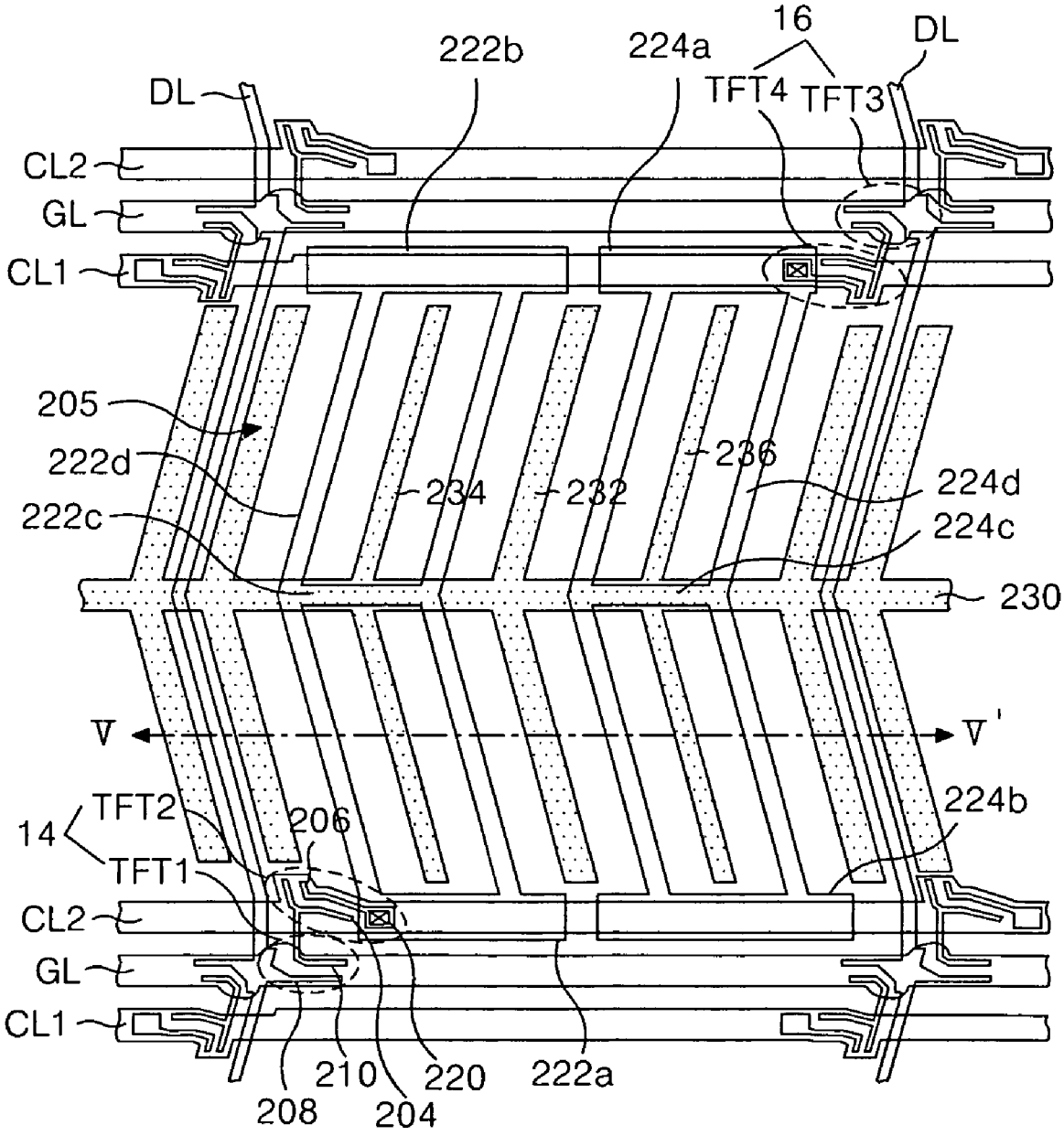
FIG. 4 is a plan view of an exemplary thin film transistor array substrate of the liquid crystal display panel shown in FIG. 2.
Figure 5:
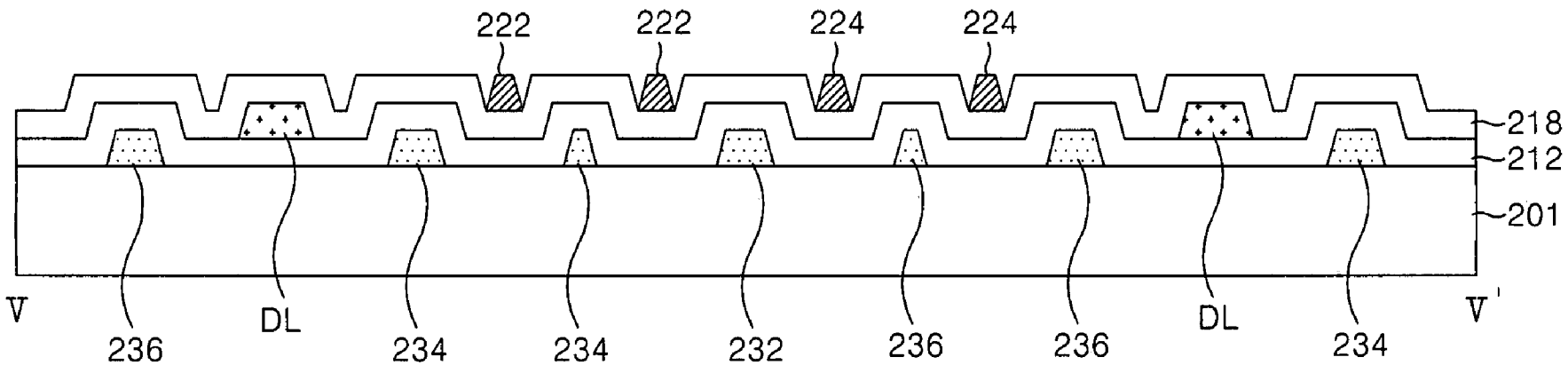
FIG. 5 is a cross-sectional view of the thin film transistor array substrate taken along line V-V' of FIG. 4.

FIG. 4 is a plan view of an exemplary thin film transistor array substrate of the liquid crystal display panel shown in FIG. 2. FIG. 5 is a cross-sectional view of the thin film transistor array substrate taken along line V-V' of FIG. 4. Referring to FIG. 4 and FIG. 5, the thin film transistor array substrate includes a gate line GL provided on a lower substrate 201. First and second control lines CL1 and CL2 are positioned at each side of the gate line GL. Thus, the gate line GL is positioned between the first and second control lines CL1 and CL2. A data line DL crosses the first and second control lines CL1 and CL2. First and second liquid crystal cells 10 and 12 are alternately provided at each crossing of the gate lines GL1 to GLn and the data lines DL1 to DLm/2.

A first switching part 14 is provided for driving the first liquid crystal cell 10. The first switching part 14 is provided at the right side of the data line DL, that is, at even-numbered vertical lines. The first switching part 14 includes first and second thin film transistors TFT1 and TFT2 to drive the first liquid crystal cell 10.

A second switching part 16 is provided for driving the second liquid crystal cell 12. The second switching part 16 is provided at the left side of the data line DL, that is, at the odd-numbered vertical lines. The second switching part 16 includes third and fourth thin film transistors TFT3 and TFT4.

The gate line GL applies a gate signal to gate electrodes of the first and third thin film transistors TFT1 and TFT3. The data line DL applies a pixel signal, via a source electrode 208 of the first thin film transistor TFT1 and the second thin film transistor TFT2, to a first pixel electrode 222. The data line DL applies a pixel signal, via a source electrode of the third thin film transistor TFT3 and the fourth thin film transistor TFT4, to a second pixel electrode 224.

The common line 230 is formed parallel to the gate line GL and is provided between the first and second liquid crystal cells 10 and 12. The common line 230 applies a reference voltage generated from the common voltage generator 26 to the first and second common electrodes 234 and 236 for liquid crystal driving. Further, the common line 230 applies a reference voltage to a common electrode 232, which is shared by the first and second liquid crystal cells 10 and 12.

The control lines CL1 and CL2 apply control signals to the gate electrodes of the second and fourth thin film transistors TFT2 and TFT4. The first control line CL1 applies a first control signal to the gate electrode of the fourth thin film transistor TFT4. The second control line CL2 applies a second control signal to the gate electrode of the second thin film transistor TFT2.

The first thin film transistor TFT1 is connected to the data line DL and the gate line GL. The first thin film transistor TFT1 applies a pixel signal from the data line DL to the source electrode 204 of the second thin film transistor TFT2 in response to a gate signal on the gate line GL. In this regard, the first thin film transistor TFT1 has a gate electrode connected to the gate line GL, and a drain electrode 210 connected to the source electrode 204 of the second thin film transistor TFT2.

The second thin film transistor TFT2 is connected between the first thin film transistor TFT1 and the first liquid crystal cell 10. In response to a second control signal on the second control line CL2, the second thin film transistor TFT2 charges the pixel signal applied to the source electrode 204 thereof into the first pixel electrode 222 and holds the applied pixel signal. In this regard, the second thin film transistor TFT2 has a gate electrode connected to the second control line CL2, a source electrode connected to the drain electrode 210 of the first thin film transistor TFT1, and a drain electrode 206 connected to the first pixel electrode 222.

The third thin film transistor TFT3 applies a pixel signal from the data line DL to the source electrode of the fourth thin film transistor TFT4 in response to a gate signal on the gate line GL. In this regard, the third thin film transistor TFT3 has a gate electrode connected to the gate line GL, a source electrode connected to the data line DL, and a drain electrode connected to the source electrode of the fourth thin film transistor TFT4.

In response to the first control signal on the first control line CL1, the fourth thin film transistor TFT4 charges the pixel signal applied to the source electrode thereof into the second pixel electrode 224 and holds the charged signal to the second pixel electrode 224. In this regard, the fourth thin film transistor TFT4 has a gate electrode connected to the first control line CL1, a source electrode connected to the drain electrode of the third thin film transistor TFT3, and a drain electrode connected to the second pixel electrode 224.

The first liquid crystal cell 10 includes the first common electrode 234 and the first pixel electrode 222 for generating an horizontal electric field. Herein, the first pixel electrode 222 includes a first horizontal part 222*a* overlapping the second control line CL2, a second horizontal part 222*b* overlapping the first control line CL1, a third horizontal part 222*c* overlapping the common line 230, and a finger part 222*d* provided between the first to third horizontal parts 222*a*, 222*b* and 222*c* to generate the horizontal electric field along the first common electrode 234.

The second liquid crystal cell 12 includes the second common electrode 236 and the second pixel electrode 224 for generating an horizontal electric field. Herein, the second pixel electrode 224 includes a first horizontal part 224*a*overlapping the first control line CL1, a second horizontal part 224*b* overlapping the second control line CL2, a third horizontal part 224*c* overlapping the common line 230, and a finger part 224*d* provided between the first to third horizontal parts 224*a*, 224*b* and 224*c* to generate the horizontal electric field along the second common electrode 236.

The first and second liquid crystal cells 10 and 12 are provided at the left and right sides of the pixel area 205 and have the shared common electrode 232 between them. Specifically, the first liquid crystal cell 10 is provided at the left of the shared common electrode 232 while the second liquid crystal cell 12 is provided at the right of the shared common electrode 232. The shared common electrode 232 is wider (e.g. about 13 μm) than other first and second common electrodes 234 and 236, thereby preventing an interference between first and second pixel voltages applied to the first and second pixel electrodes 222 and 224.

Figure 1:
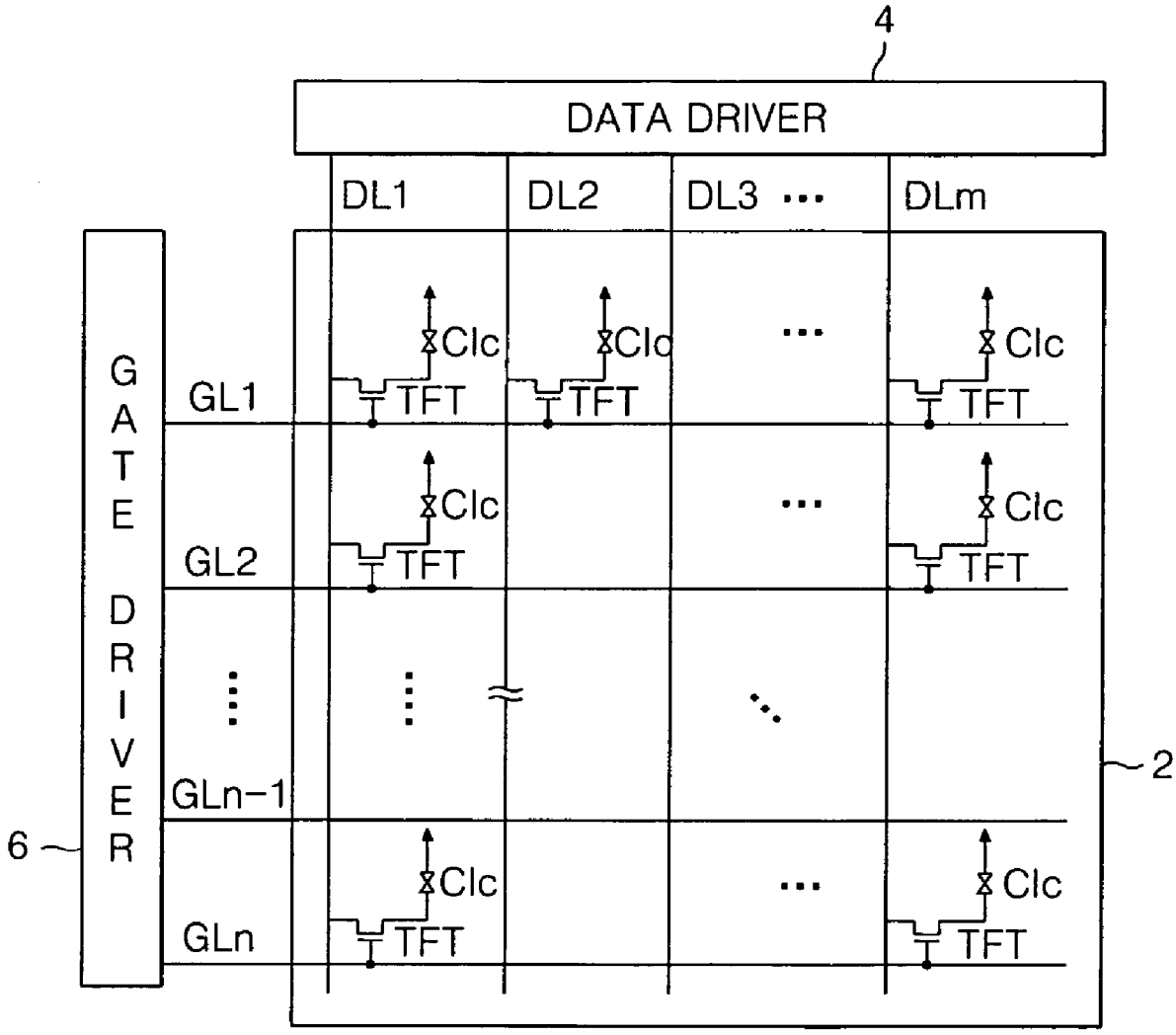
FIG. 1 RELATED ART
FIG. 1 is a block circuit diagram of a liquid crystal display according to a related art.

As described above, the first and second liquid crystal cells 10 and 12 are provided at the left and right sides with one data line DL between them. Herein, the first and second liquid crystal cells 10 and 12 are supplied with pixel signals from adjacent data lines DL. Accordingly, in an embodiment of the present invention, the number of data lines DL in the liquid crystal display device is reduced by half in comparison with the related art liquid crystal display device shown in FIG. 1.

Figure 6A:
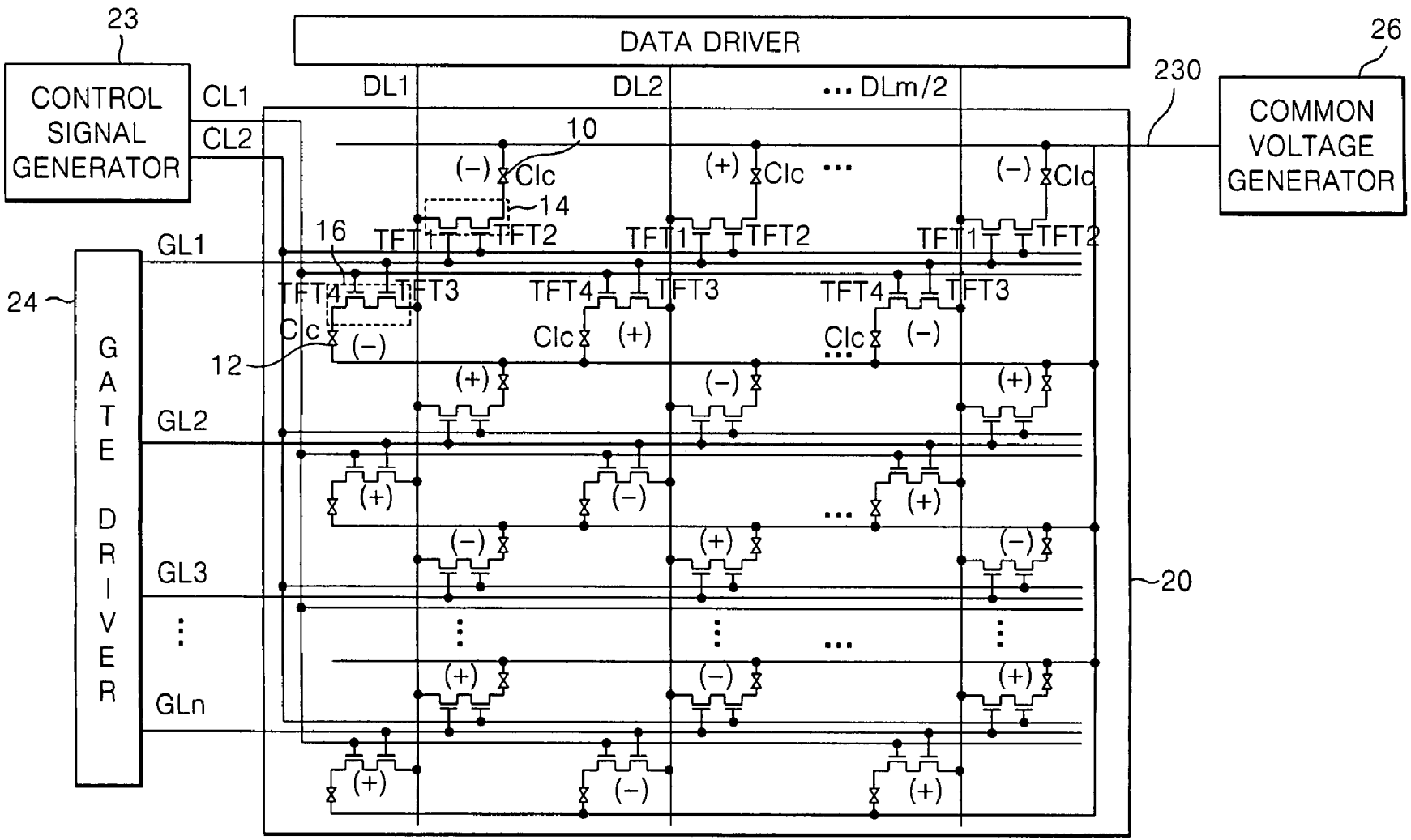
FIG. 6A shows an exemplary horizontal two-dot inversion system with pixel signals of opposite polarities applied to the liquid crystal cells during an odd frame period, according to an embodiment of the present invention.
Figure 6B:
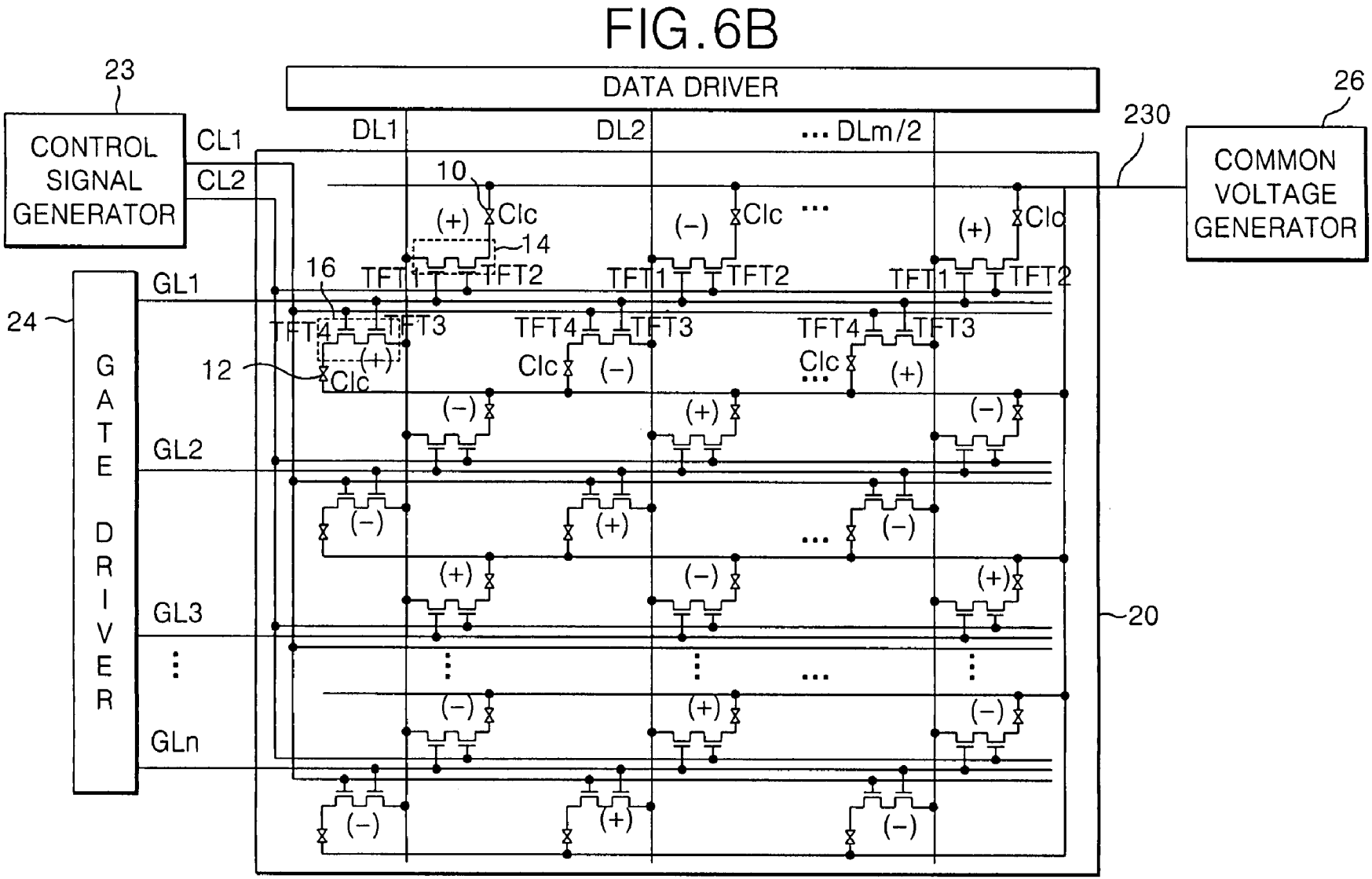
FIG. 6B shows an exemplary horizontal two-dot inversion system with pixel signals of opposite polarities applied to the liquid crystal cells during an even frame period, according to an embodiment of the present invention.

FIG. 6A shows an exemplary horizontal two-dot inversion system with pixel signals of opposite polarities applied to the liquid crystal cells during an odd frame period, according to an embodiment of the present invention. FIG. 6B shows an exemplary horizontal two-dot inversion system with pixel signals of opposite polarities applied to the liquid crystal cells during an even frame period, according to an embodiment of the present invention. Referring to FIG. 6A and FIG. 6B, the liquid crystal display panel is driven by an horizontal two-dot inversion system. In the horizontal two-dot inversion system, the polarities of the pixel signals are changed for a dot unit in the vertical direction while being changed for a two-dot unit in the horizontal direction during the odd frame period and the even frame period.

Referring to FIG. 6A, during an odd frame period, a positive(+) pixel signal and a negative(−) pixel signal are alternately and repetitively supplied to two pixel electrodes connected to an horizontal line, while corresponding pixel signals of the opposite polarities are supplied to the vertically adjacent pixel electrodes. The first and second pixel electrodes positioned at the left and right sides of a shared common electrode are supplied with pixel signals having the same polarity. Referring to FIG. 6B, during an even frame period, a negative(−) pixel signal and a positive(+) pixel signal are alternately and repetitively supplied to two pixel electrodes connected to an horizontal line, while corresponding pixel signals of the opposite polarities are supplied to the vertically adjacent pixel electrodes. In this regard, a pixel signal must be supplied to the second liquid crystal cell 12 by the dot inversion system during the first half-frame period of each frame, whereas a pixel signal must be to the first liquid crystal cell 10 by the dot inversion system during the second half-frame period of each frame.

Figure 7A:
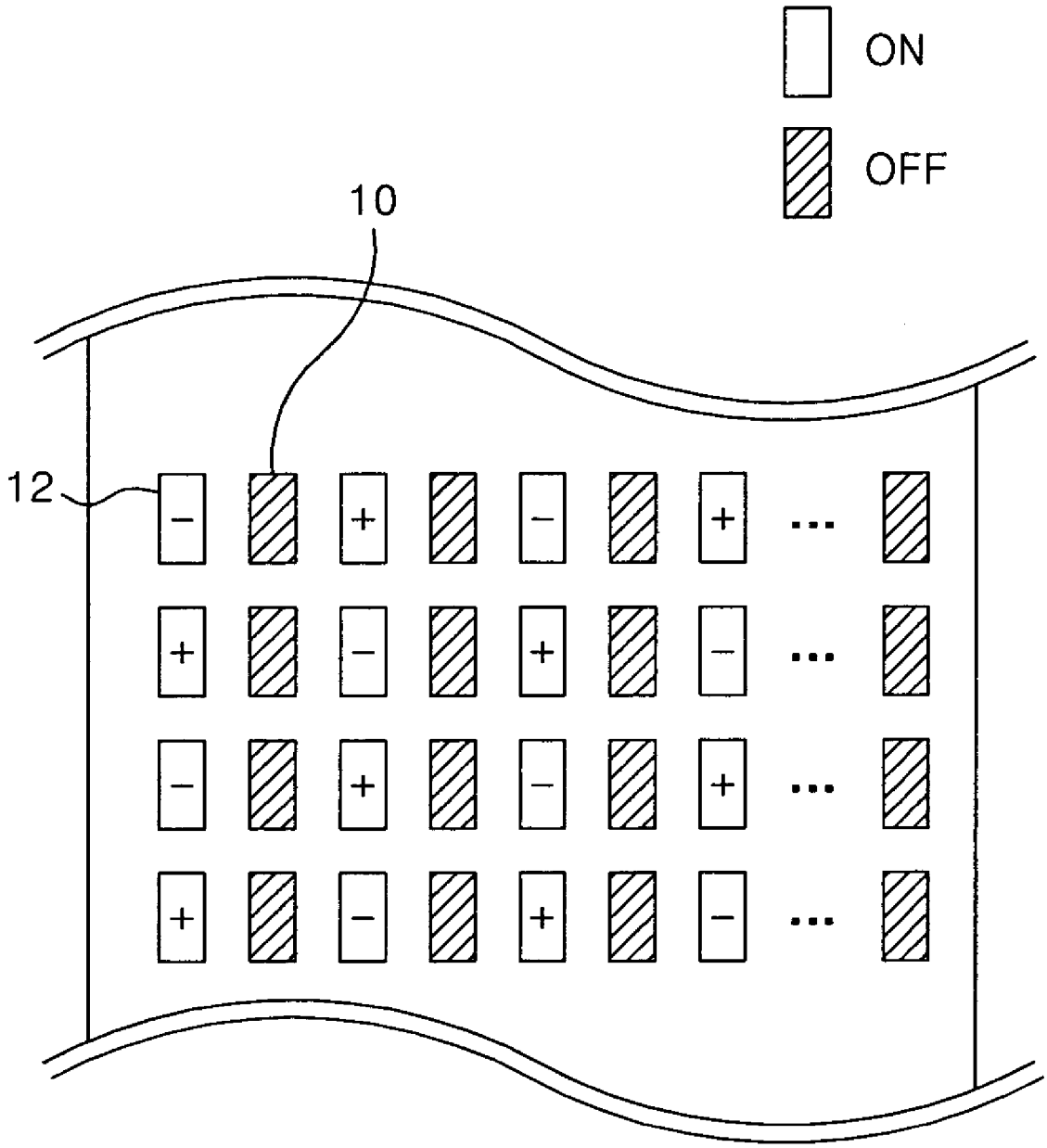
FIG. 7A and FIG. 7B depict the liquid crystal cells being driven in response to the control signal shown in FIG. 3.
Figure 7B:
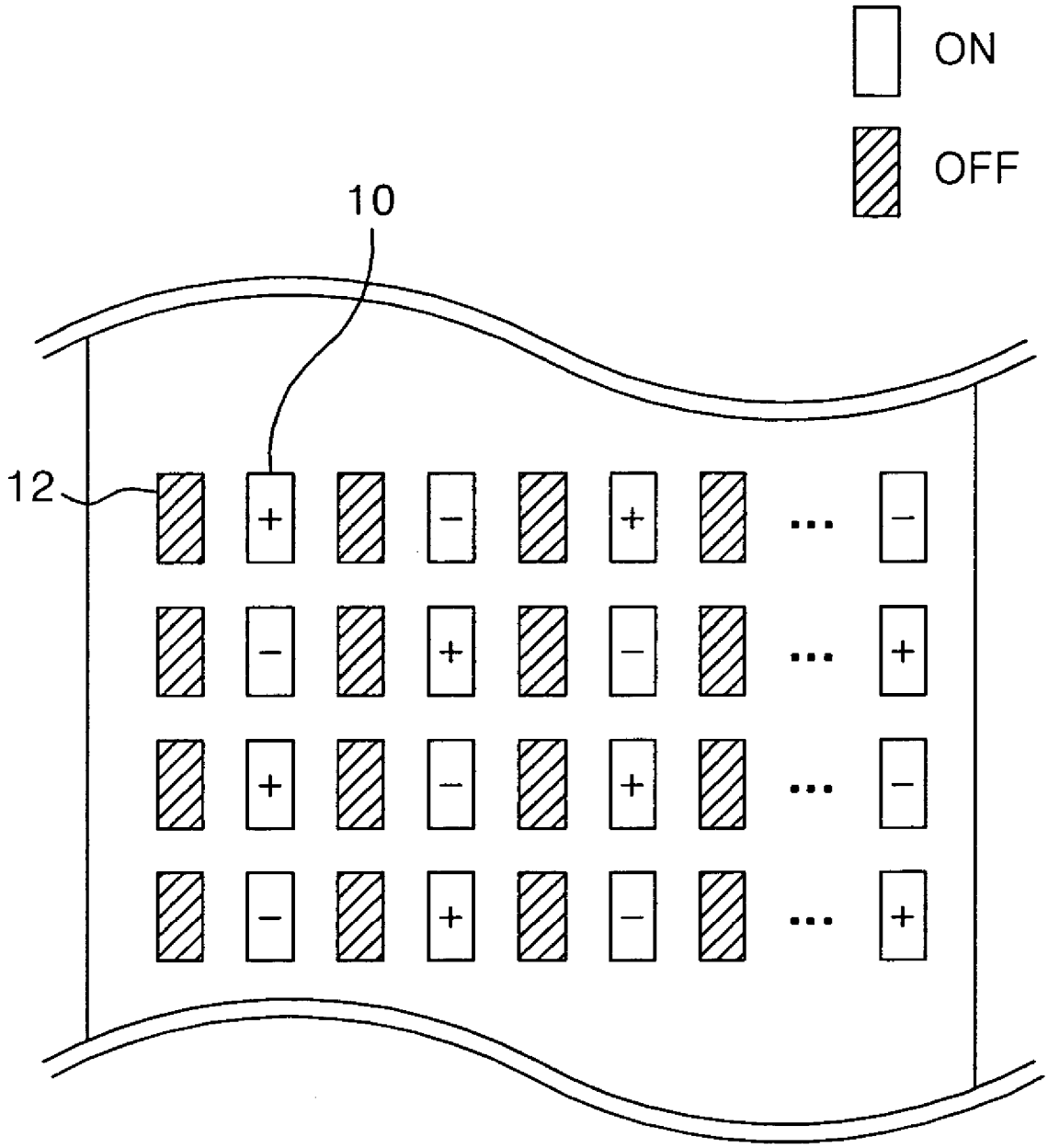

FIG. 7A and FIG. 7B depict the liquid crystal cells being driven in response to the control signal shown in FIG. 3. During the first half-frame period, the first control signal CS1 is applied to the first control line CL1. Then, the fourth thin film transistor TFT4 connected to the first control line CL1 is turned on. During the same period, the second thin film transistor TFT2 remains off.

During the first half-frame period, the gate signal SP is sequentially applied to the gate lines GL1 to GLn. Then, for each horizontal line, the third thin film transistor TFT3 connected to the corresponding gate line GL is turned on. Pixel signals are applied by the dot inversion system, via the data lines DL1 to DLm/2, to the second liquid crystal cell 12. Then, the pixel signals supplied to the data lines DL1 to DLm/2 are applied, via the third and fourth thin film transistors TFT3 and TFT4, to the second liquid crystal cell 12.

As shown in FIG. 7A, during the first half-frame period, the second liquid crystal cells 12 positioned at odd-numbered vertical lines are driven. In this instance, the first thin film transistors TFT 1 also are sequentially turned on by the gate signals SP while the second thin film transistors TFT2 are turned off. Thus, pixel signals are not supplied to the first liquid crystal cell 10.

During the second half-frame period, the second control signal CS2 is applied to the second control line CL2. Then, the second thin film transistor TFT2 connected to the second control line CL2 is turned on. At this time, the fourth thin film transistor TFT4 remains off.

During the second half-frame period, the gate signal SP is sequentially applied to the gate lines GL1 to GLn. Then, for each horizontal line, the first thin film transistor TFT1 connected to the gate line GL is turned on. Pixel signals are supplied by the dot inversion system, via the data lines DL1 to DLm/2, to the first liquid crystal cell 10. Then, the pixel signals supplied to the data lines DL1 to DLm/2 are applied, via the first and second thin film transistors TFT1 and TFT2, to the first liquid crystal cell 10.

As shown in FIG. 7B, during the second half-frame period, the first liquid crystal cells 10 positioned at even-numbered vertical lines are driven. Then, pixel signals having the same polarity as the adjacent second liquid crystal cell 12 at the left or right side of the first liquid crystal cell 10 are also driven. Accordingly, pixel signals having the same polarity are charged into the first and second liquid crystal cells 10 and 12 positioned between the i-th data line DL and the (i+1)-th data line DLi+1, so that the liquid crystal display panel is driven by the horizontal two-dot inversion system. The third thin film transistors TFT3 also are sequentially turned on by the gate signals SP, while the fourth thin film transistors TFT4 are turned off. Thus, the pixel signals are not supplied to the second liquid crystal cell 12.

According to the described embodiment of the present invention, the LCD applies the control signals CS1 and CS2 alternately for each half-frame period to the first and second control lines CL1 and CL2, thereby alternately turning on the second thin film transistors TFT2 or the fourth thin film transistors TFT4. Thus, the first and second liquid crystal cells 10 and 12 are alternately driven for each half-frame period. Furthermore, the LCD supplies appropriate pixel signals to the first and second liquid crystal cells 10 and 12 positioned at the left and right sides using a single data line DL. Thus, the number of data lines DL and the number of data drive IC's are reduced to half as much as the related art. Accordingly, manufacturing cost is reduced.

Alternatively, in another embodiment of the present invention, the second control signal CS2 may be applied during the first half-frame period while applying the first control signal CS1 during the second half-frame period. Then, during the first half-frame period, the first liquid crystal cells 10 positioned at even-numbered horizontal lines, as shown in FIG. 7B, are driven while the second liquid crystal cells 12 positioned at the odd-numbered horizontal lines, as shown in FIG. 7A, are driven. In other words, the LCD can control an application sequence of the first and second control signals CS1 and CS2 to thereby control a driving sequence of the first and second liquid crystal cells 10 and 12.

In the above-described embodiment of the present invention, the liquid crystal display device is driven by the horizontal two-dot inversion system such that pixel signals having the same polarity are applied to the first and second pixel electrodes positioned at the left and right sides of a shared common electrode. Accordingly, the pixel signals applied to the first and second pixel electrodes will exert no effect on each other, thereby preventing a horizontal electric field distortion phenomenon.

Figure 8A:
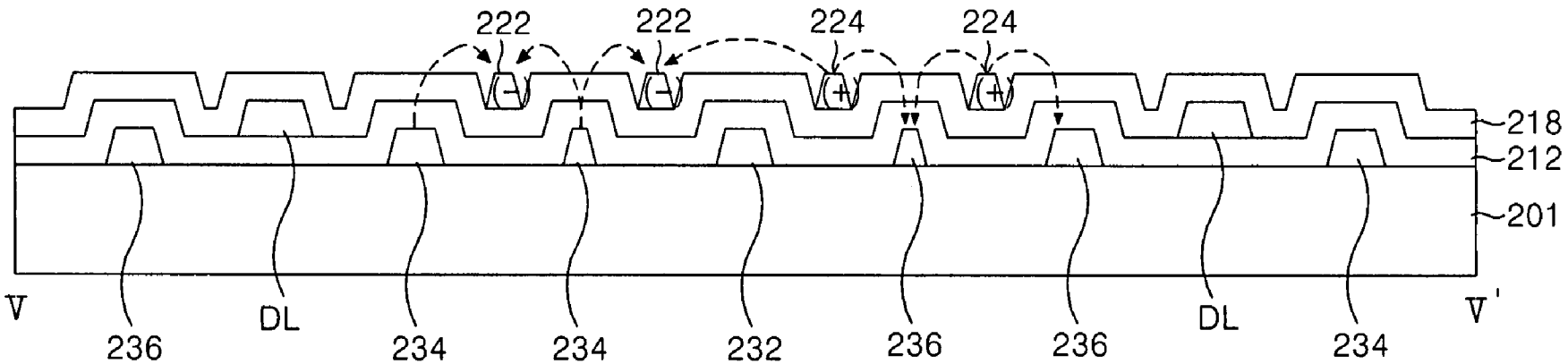
FIG. 8A illustrates horizontal electric fields generated between pixel electrodes when a voltage is applied to the liquid crystal display device driven by a one-dot inversion system.

FIG. 8A illustrates horizontal electric fields generated between pixel electrodes when a voltage is applied to the liquid crystal display device driven by a one-dot inversion system. Referring to FIG. 8A, a shared common electrode 232 is positioned between a the first pixel electrode 222 and a second pixel electrode 224. A negative(−) pixel signal is applied to the first pixel electrode 222, which is at the left of the shared common electrode 232, whereas a positive(+) pixel signal is applied to the second pixel electrode 224, which is at the right of the shared common electrode 232. Herein, the positive(+) pixel signal has a voltage of 14V, for example. The negative(−) pixel signal has a voltage of 0V. A common voltage of 7V is applied to the common electrodes 234 and 236 and the shared common electrode 232.

In this configuration, a horizontal electric field of about 7V is formed between any one of the first and second pixel electrodes 222 and 224, and the common electrodes 234 and 236. Liquid crystal molecules are rotated by this horizontal electric field. Light transmittance changes in accordance with a rotational angle of the liquid crystal molecules, thereby implementing a picture. However, the first and second pixel signals 222 and 224, which have the shared common electrode 232 therebetween, have opposite polarities. In this case, a horizontal electric field is not formed between the shared common electrode 232 and the first pixel electrode (or the second pixel electrode). In contrast, a horizontal electric field of about 14V is formed between the first and second pixel electrodes 222 and 224 adjacent to each other and on opposite sides of the shared common electrode 232. This horizontal electric field difference changes the light transmittance of at least one of the first and second liquid crystal cells 10 and 12.

Figure 8B:
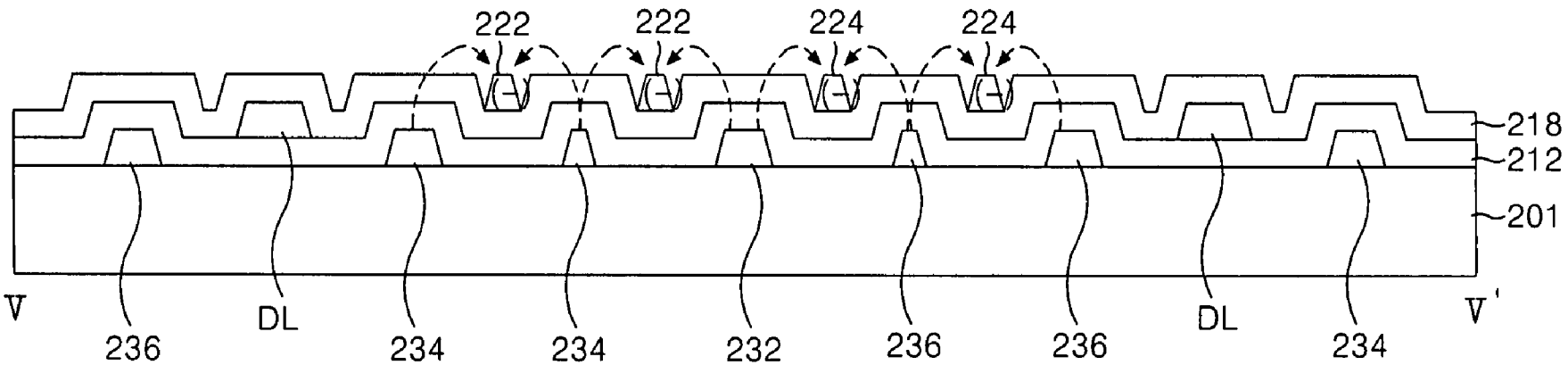
FIG. 8B illustrates horizontal electric fields generated between pixel electrodes when a voltage is applied to the liquid crystal display device driven by a two-dot inversion system.

FIG. 8B illustrates horizontal electric fields generated between pixel electrodes when a voltage is applied to the liquid crystal display device drivenby a two-dot inversion system. Referring to FIG. 8B, a shared common electrode 232 is positioned between a the first pixel electrode 222 and a second pixel electrode 224. A negative(−) pixel signal is applied to the first pixel electrode 222 positioned at the left of the shared common electrode 232. A negative(−) pixel signal is applied to the second pixel electrode 224 positioned at the right side of the shared common electrode 232. Herein, the negative(−) pixel signal has a voltage of 0V. A common voltage of 7V is applied to the common electrodes 234 and 236 and the shared common electrode 232.

In this configuration, a horizontal electric field of about 7V is formed between any one of the first and second pixel electrodes 222 and 224 and the common electrodes 234 and 236. Similarly, a horizontal electric field of about 7V is formed between the first and second pixel electrodes 222 and 224 adjacent to the shared common electrode 232. Voltage differences between the common electrodes 234 and 236 and the pixel electrodes 222 and 224 are equal. Thus, a variation in light transmittance of the liquid crystal cells 10 and 12 is prevented.

Figure 9A:
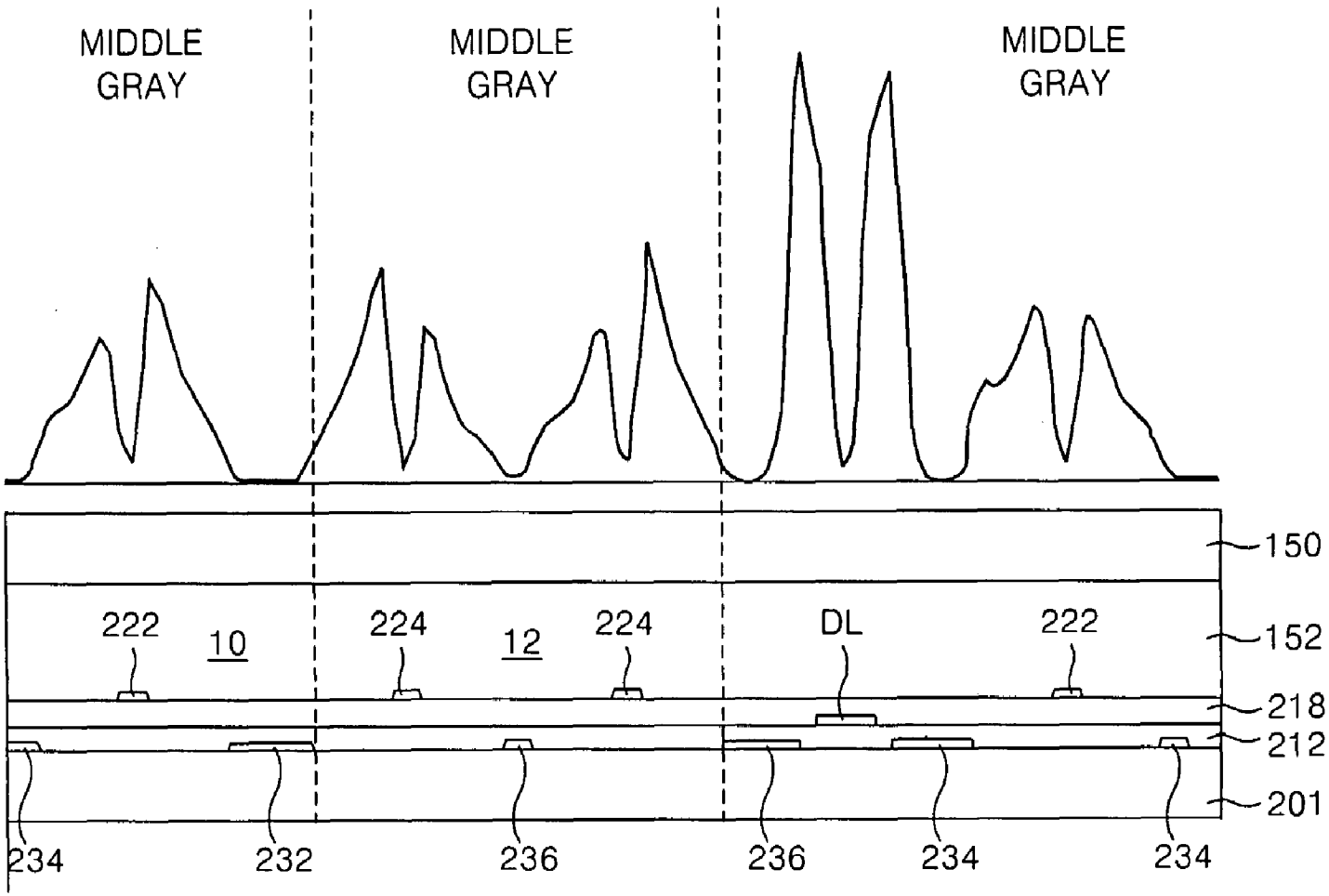
FIG. 9A to FIG. 9C depict exemplary variations of light transmittance within the liquid crystal display device driven by the one-dot inversion system.
Figure 9B:
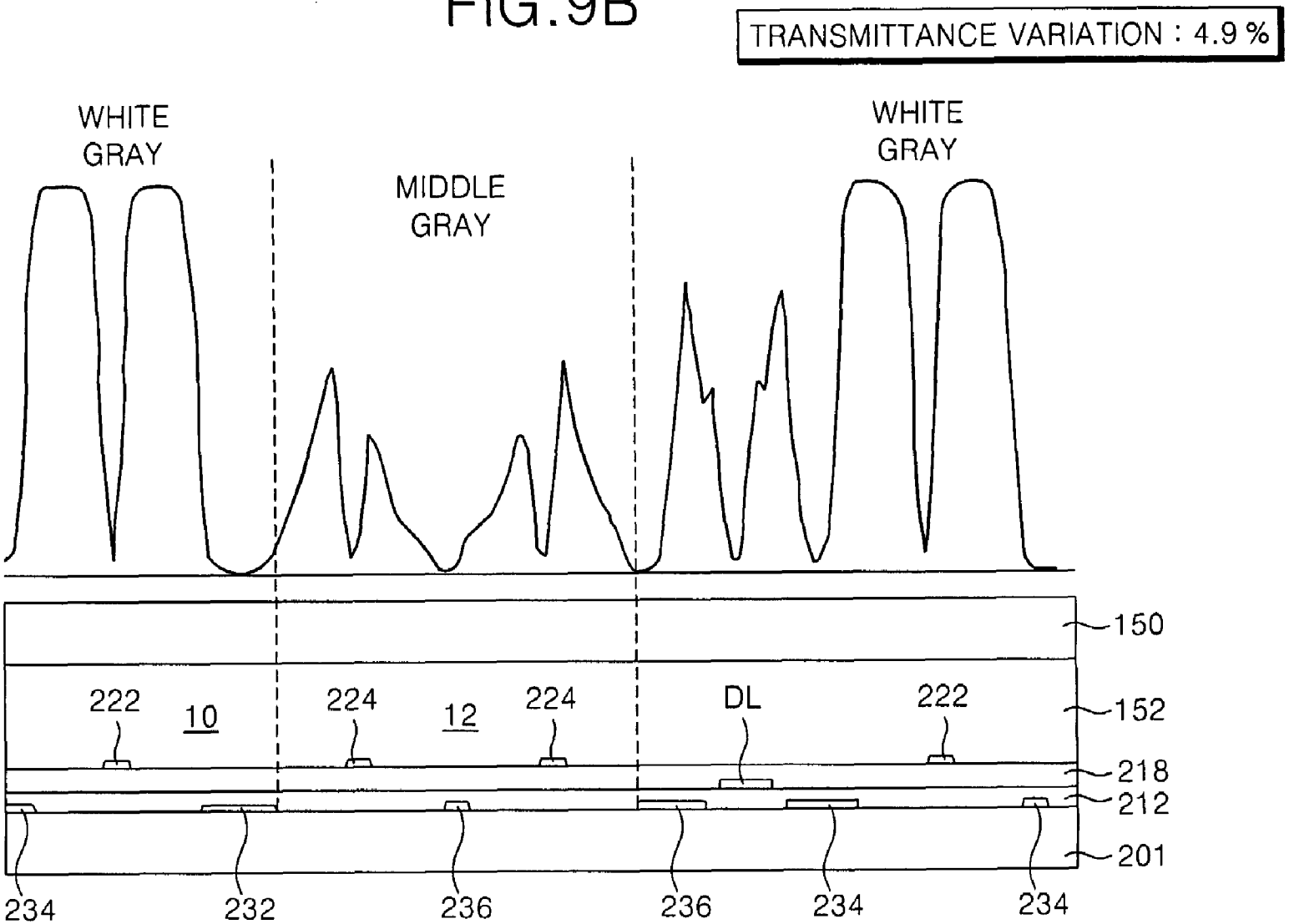
Figure 9C:
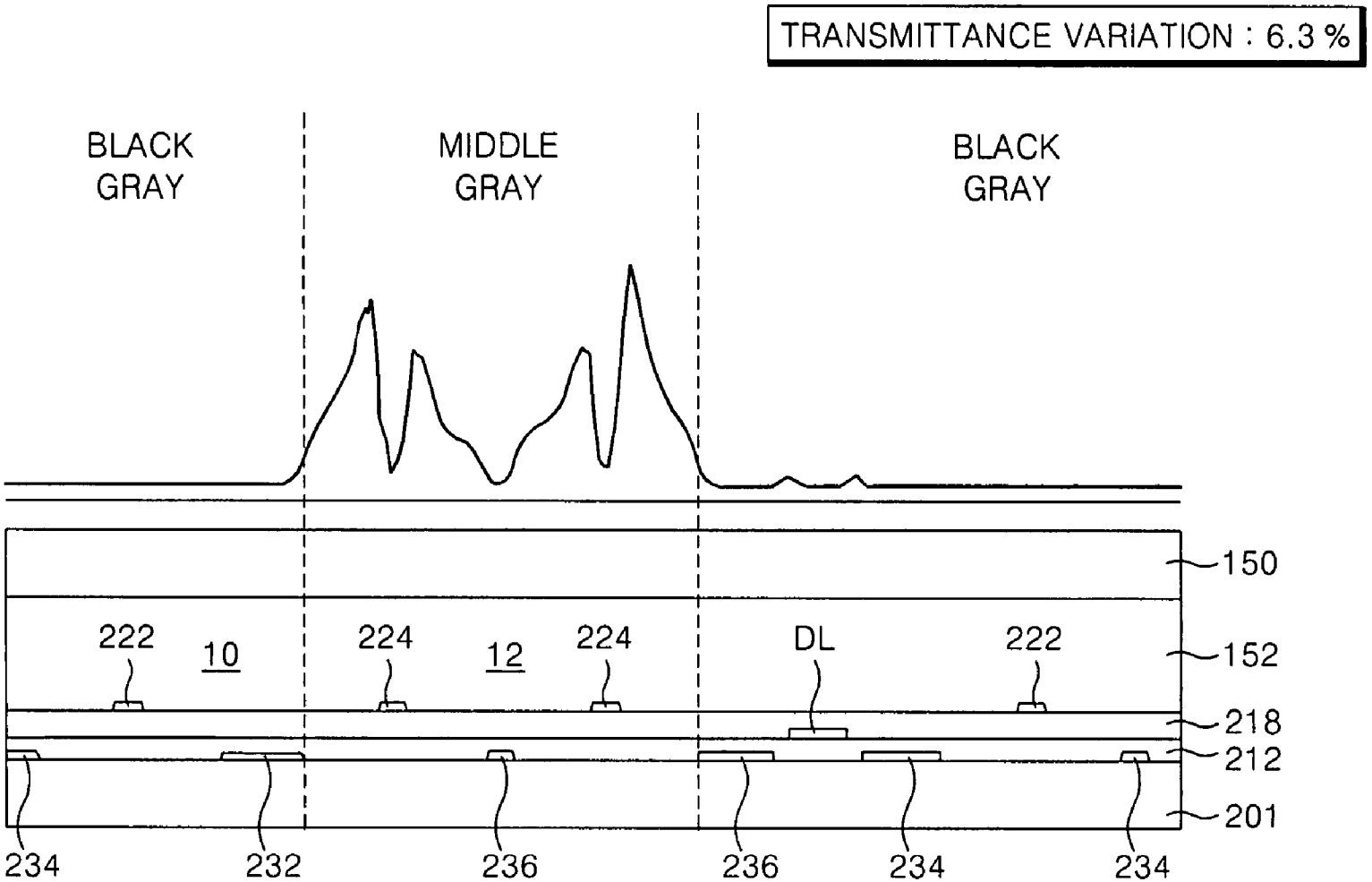

FIG. 9A to FIG. 9C depict exemplary variations of light transmittance within the liquid crystal display device driven by the one-dot inversion system. Referring to FIG. 9A to FIG. 9C, the liquid crystal display device includes an upper substrate 150 and a lower substrate 201 facing each other. A liquid crystal layer 152 is provided between the upper substrate 150 and the lower substrate 201.

Referring to FIG. 9A, the first and second liquid crystal cells 10 and 12 implement the same middle gray. The shared common electrode 232 is located between the first and second liquid crystal cells 10 and 12. To implement the same middle gray within the first and second liquid crystal cells 10 and 12, a pixel voltage signal of about 3V to 11V, for example, is applied to the pixel electrodes 222 and 224. Also, a common voltage of about 7V is applied to the common electrodes 234 and 236 and the shared common electrode 232.

Further, referring to FIG. 9B, the first liquid crystal cell 10 implements a white gray while the second liquid crystal cell 12 implements a middle gray. In this instance, a pixel voltage signal of about 0V to 14V is applied to the pixel electrode 222 of the first liquid crystal cell 10 to generate a white gray, whereas a pixel voltage signal of about 3V to 11V is applied to the pixel electrode 224 of the second liquid crystal cell 12 to generate a middle gray. Further, a common voltage of about 7V is applied to the common electrodes 234 and 236 and the shared common electrode 232. In this case, light transmittance of the second liquid crystal cell 12 from the middle gray generated in FIG. 9A to the middle gray generated in FIG. 9B varies by about 4.9%. The variation in light transmittance between the middle gray generated in FIG. 9A and the middle gray generated in FIG. 9B is caused by the influence of the first pixel voltage, which is applied to the first liquid crystal cell 10, on the light transmittance of the liquid crystal cell 12 supplied with the second pixel voltage, which has opposite polarity to the first pixel voltage.

On the other hand, as shown in FIG. 9C, the first liquid crystal cell 10 implements a black gray, while the second liquid crystal cell 12 implements a middle gray. Herein, a pixel voltage signal of about 6V to 8V is applied to the pixel electrode 222 of the first liquid crystal cell 10 to generate the black gray, whereas a pixel voltage signal of about 3V to 11V is applied to the pixel electrode 224 of the second liquid crystal cell 12 to generate the middle gray. Further, a common voltage of about 7V is applied to the common electrode 234 and 236 and the shared common electrode 232. In this case, the light transmittance of the second liquid crystal cell 12 varies by about 6.3% from the middle gray in FIG. 9A to the middle gray in FIG. 9C. The variation in light transmittance between the middle gray generated in FIG. 9A and the middle gray generated in FIG. 9C is caused by the influence of the first pixel voltage, which is applied to the first liquid crystal cell 10, on the light transmittance of the liquid crystal cell 12 supplied with the second pixel voltage, which has opposite polarity to the first pixel voltage.

Figure 10A:
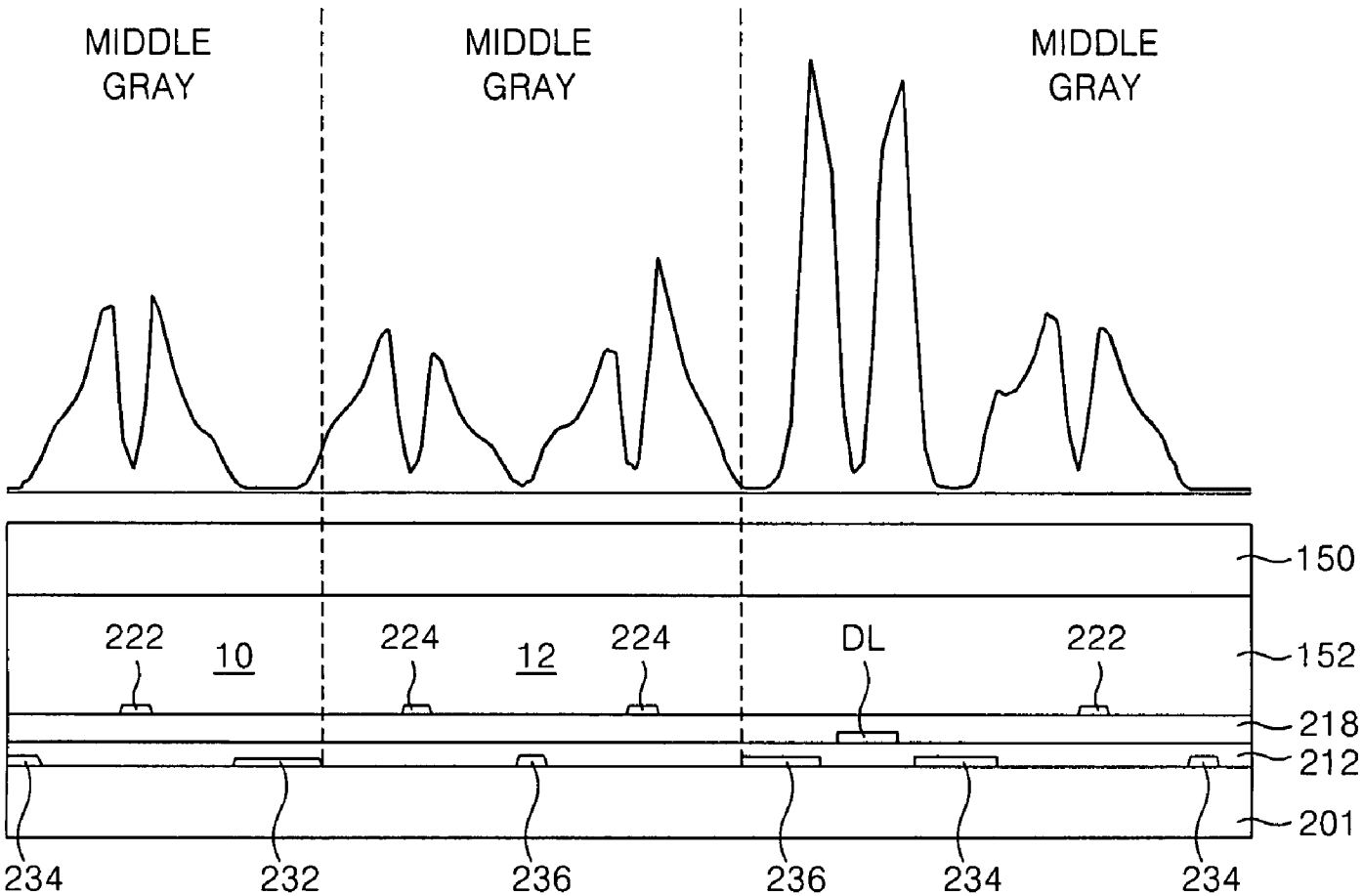
FIG. 10A to FIG. 10C depict exemplary variations of light transmittance within the liquid crystal display device driven by the horizontal two-dot inversion system.
Figure 10B:
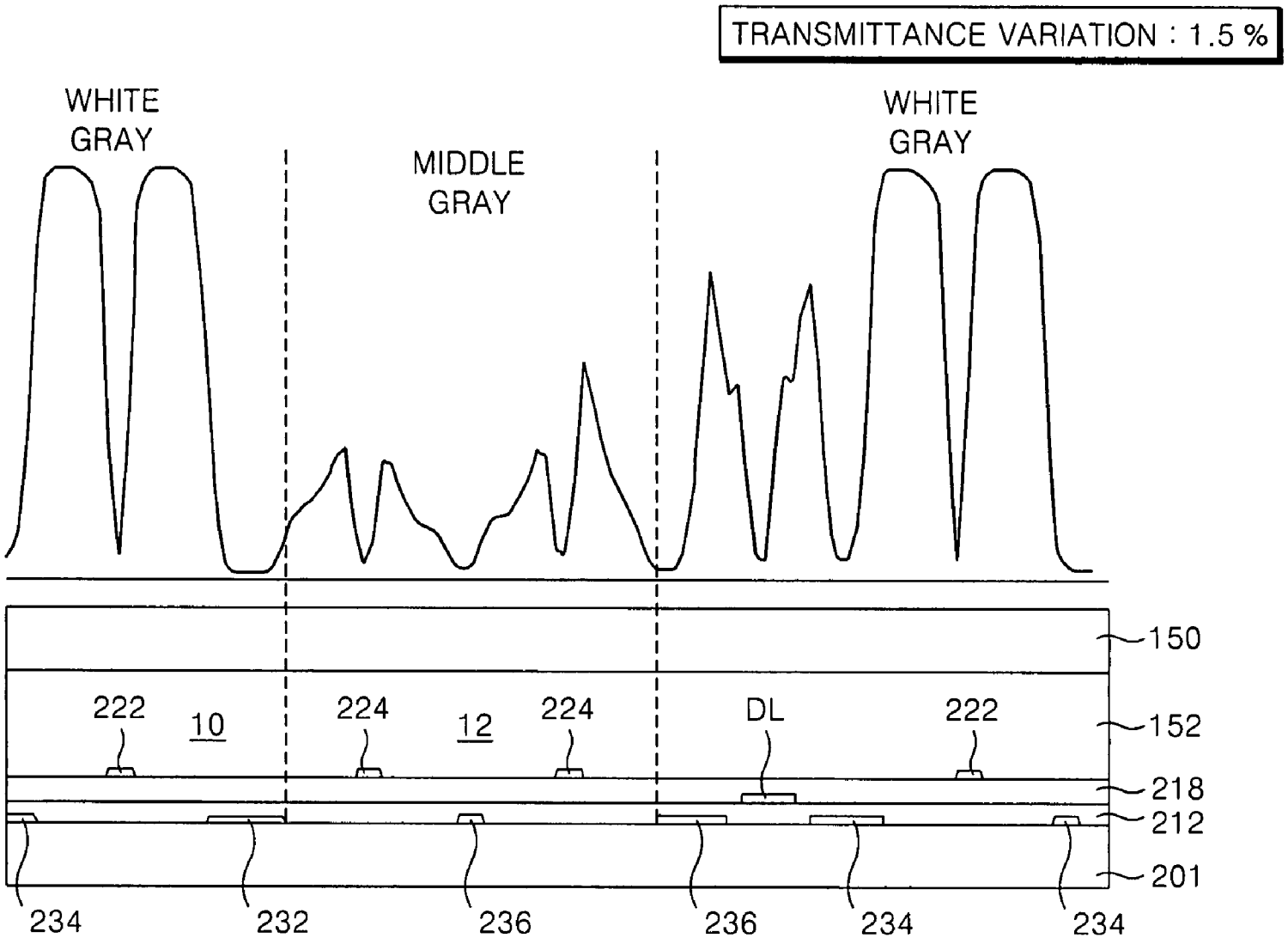
Figure 10C:
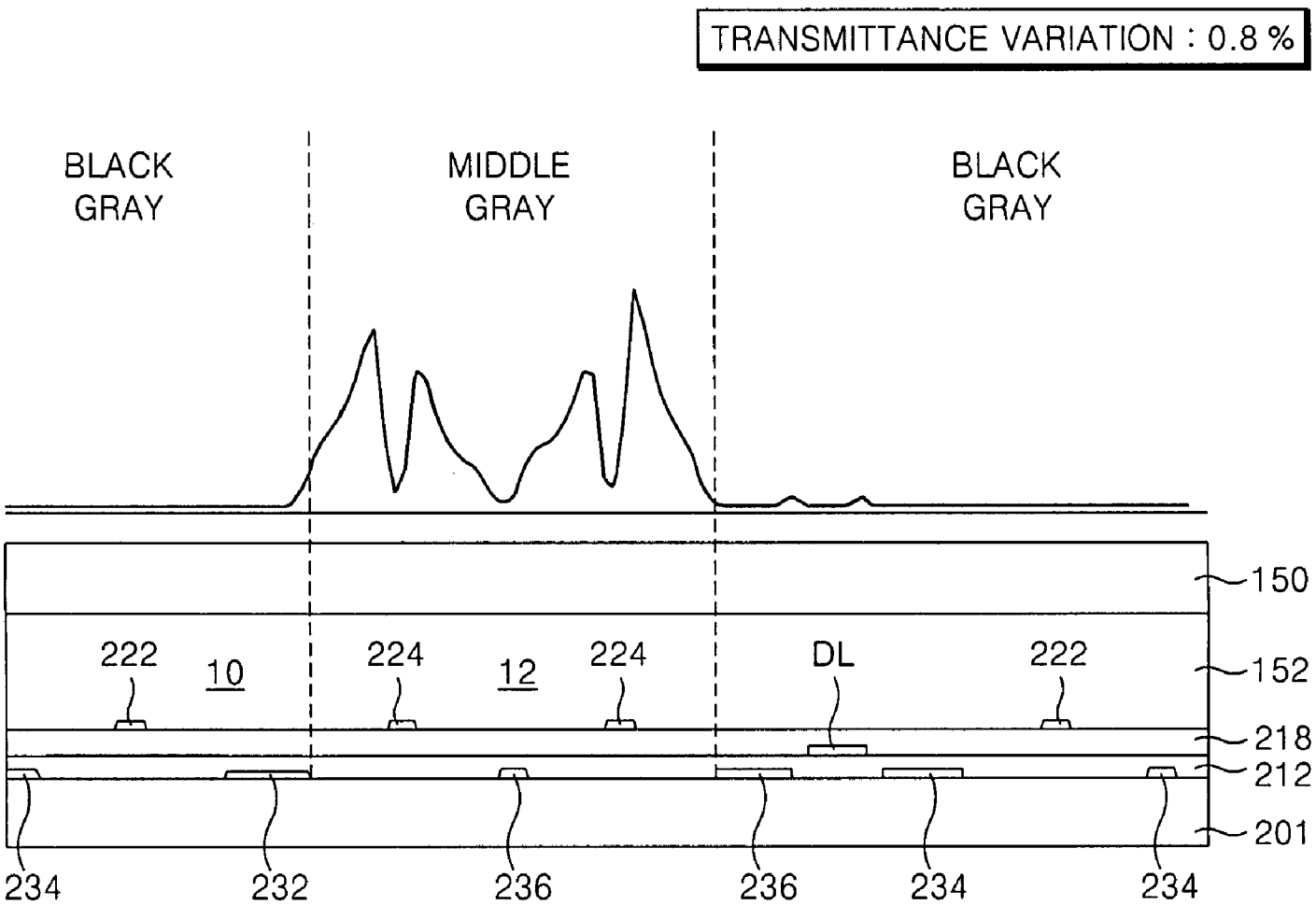

FIG. 10A to FIG. 10C depict exemplary variations of light transmittance within the liquid crystal display device driven by the horizontal two-dot inversion system. Referring to FIG. 10A to FIG. 10C, the liquid crystal display device includes an upper substrate 150 and a lower substrate 201 facing each other. A liquid crystal layer 152 is provided between the upper substrate 150 and the lower substrate 201.

As shown in FIG. 10A, the first and second liquid crystal cells 10 and 12 implement the same middle gray. The shared common electrode 232 is located between the first and second liquid crystal cells 10 and 12. To implement the same middle gray within the first and second liquid crystal cells 10 and 12, a pixel voltage signal of about 3V to 11V, for example, is applied to the pixel electrodes 222 and 224. Also, a common voltage of about 7V is applied to the common electrodes 234 and 236 and the shared common electrode 232.

Further, as shown in FIG. 10B, the first liquid crystal cell 10 implements a white gray while the second liquid crystal cell 12 implements a middle gray. In this instance, a pixel voltage signal of about 0V to 14V is applied to the pixel electrode 222 of the first liquid crystal cell 10 to generate a white gray, whereas a pixel voltage signal of about 3V to 11V is applied to the pixel electrode 224 of the second liquid crystal cell 12 to generate a middle gray. Further, a common voltage of about 7V is applied to the common electrode 234 and 236 and the shared common electrode 232. In this case, the variation in light transmittance of the second liquid crystal cell 12 from the middle gray generated in FIG. 10A to the middle gray generated in FIG. 10B is about 1.5% lower than the corresponding variation in light transmittance for the one-dot inversion system in FIG. 9B.

On the other hand, as shown in FIG. 10C, the first liquid crystal cell 10 implements a black gray, while the second liquid crystal cell 12 implements a middle gray. Herein, a pixel voltage signal of about 6V to 8V is applied to the pixel electrode 222 of the first liquid crystal cell 10 to generate the black gray, whereas a pixel voltage signal of about 3V to 11V is applied to the pixel electrode 224 of the second liquid crystal cell 12 to generate the middle gray. Further, a common voltage of about 7V is applied to the common electrode 234 and 236 and the shared common electrode 232. In this case, the variation in light transmittance of the second liquid crystal cell 12 from the middle gray generated in FIG. 10A to the middle gray generated in FIG. 10C is about 0.8% lower than the corresponding variation in light transmittance for the one-dot inversion system in FIG. 9C.

Figure 11A:
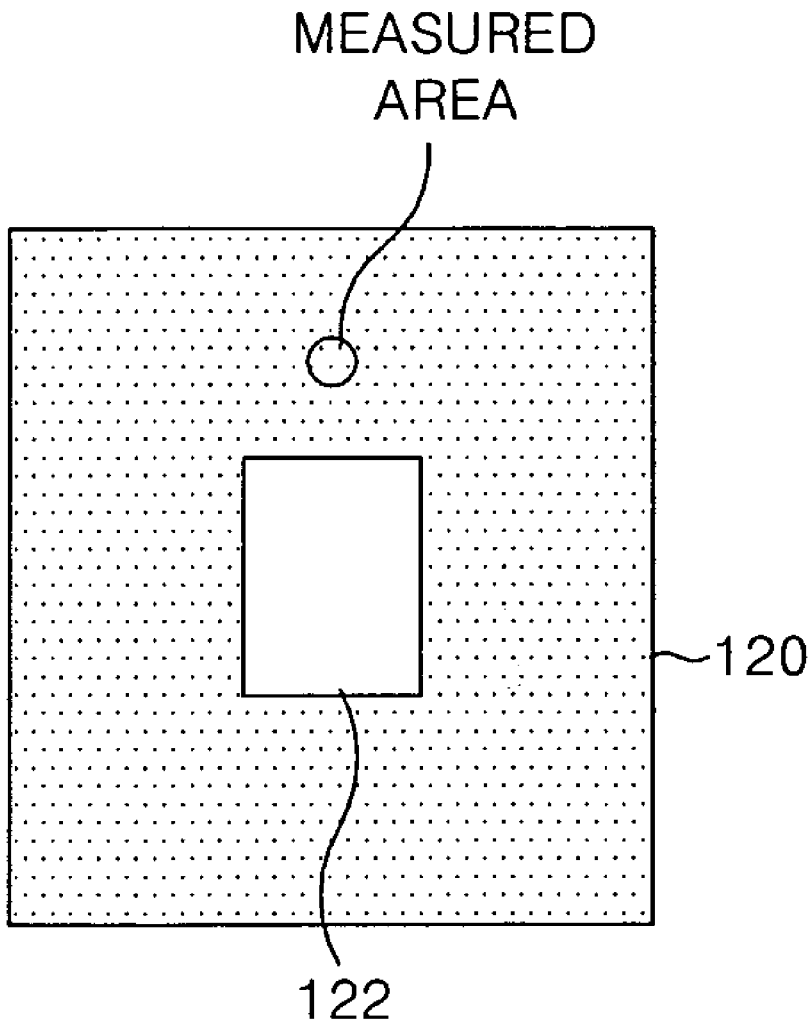
FIG. 11A depicts an exemplary arrangement for measuring a crosstalk due to a white field generated within a portion of a gray field of a liquid crystal display device.

FIG. 11A depicts an exemplary arrangement for measuring a crosstalk due to a white field generated within a portion of a gray field of a liquid crystal display device. In a first time period, a gray level is implemented across the entire field 120. Then, during a second time period, a white level is implemented in a window 122 within a portion of the gray field 120. In each of the first and second time periods, brightness is measured at a measured area.

Figure 11B:
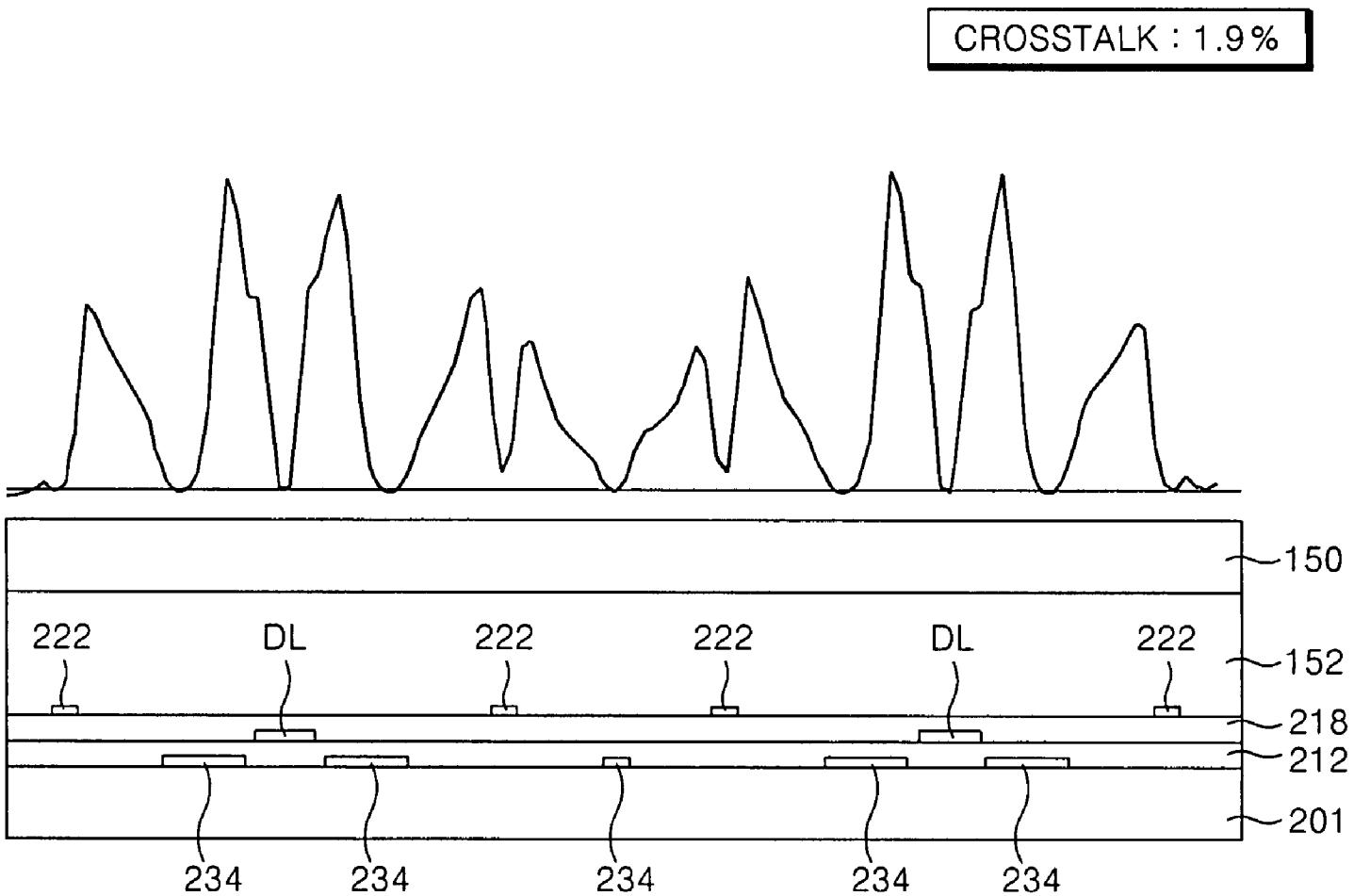
FIG. 11B shows exemplary crosstalk measurements within the liquid crystal display device of FIG. 11A, when driven by the one-dot inversion system.

FIG. 11B shows exemplary crosstalk measurements within the liquid crystal display device of FIG. 11A, when driven by the one-dot inversion system. As shown in FIG. 11B, when the liquid crystal display device is driven by the one-dot inversion system, brightness at the measured area varies by about 1.9% between the first period, when the gray level covers the entire field 120, and the second time period, when the white window 122 is generated within a portion of the field 120. The variation in the measured brightness is due to crosstalk between the white window 122 and the surrounding gray level in the field 120.

Figure 11C:
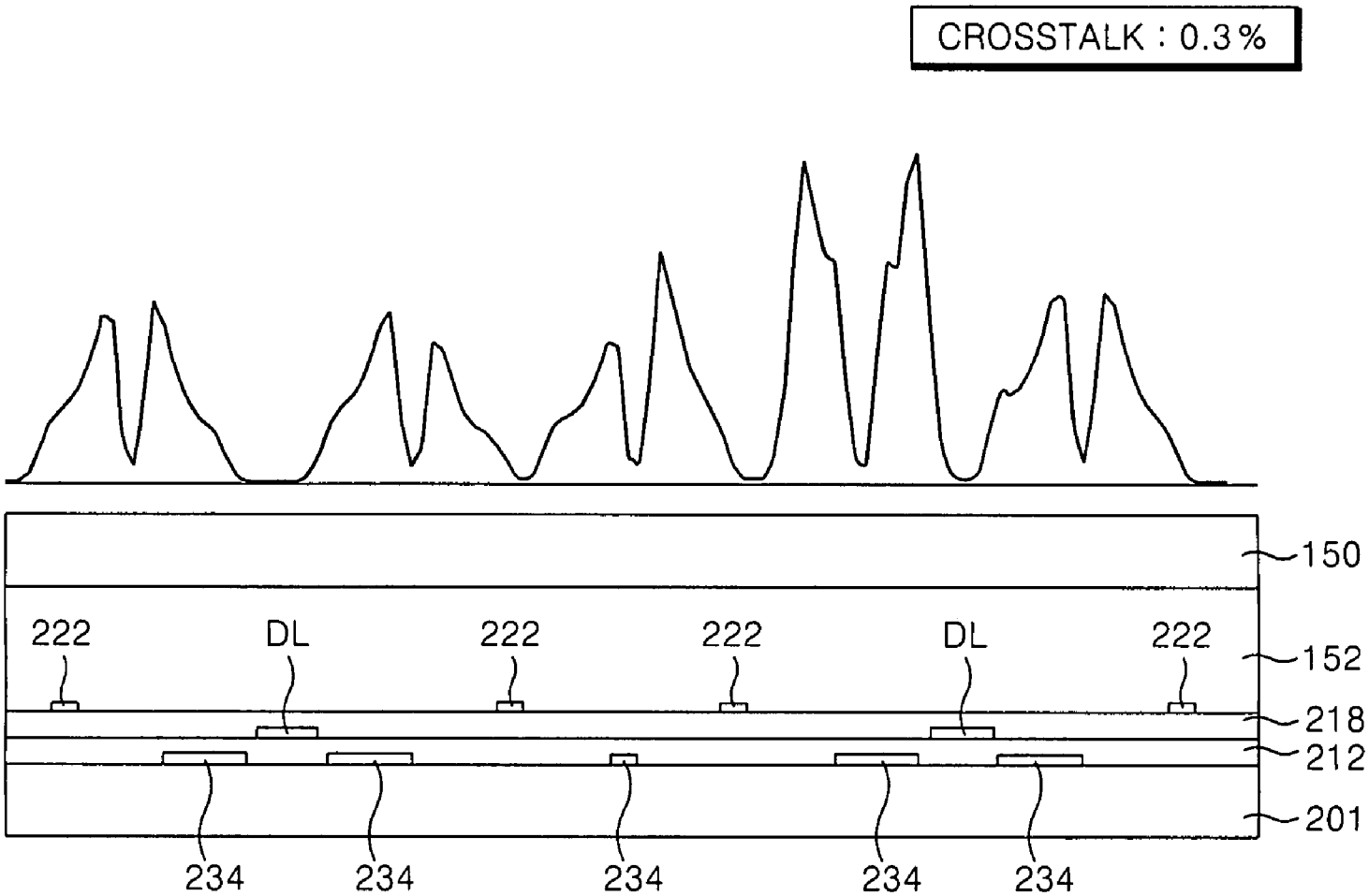
FIG. 11C shows exemplary crosstalk measurements within the liquid crystal display device of FIG. 11A, when driven by the horizontal two-dot inversion system.

FIG. 11C shows exemplary crosstalk measurements within the liquid crystal display device of FIG. 11A, when driven by the horizontal two-dot inversion system. As shown in FIG. 11C, when the liquid crystal display device is driven by the horizontal two-dot inversion system, brightness at the measured area varies by about 0.3% between the first period, when the gray level covers the entire field 120, and the second time period, when the white window 122 is generated within a portion of the field 120. Thus, crosstalk is reduced by the horizontal two-dot inversion system compared to the one-dot inversion system.

Figure 12A:
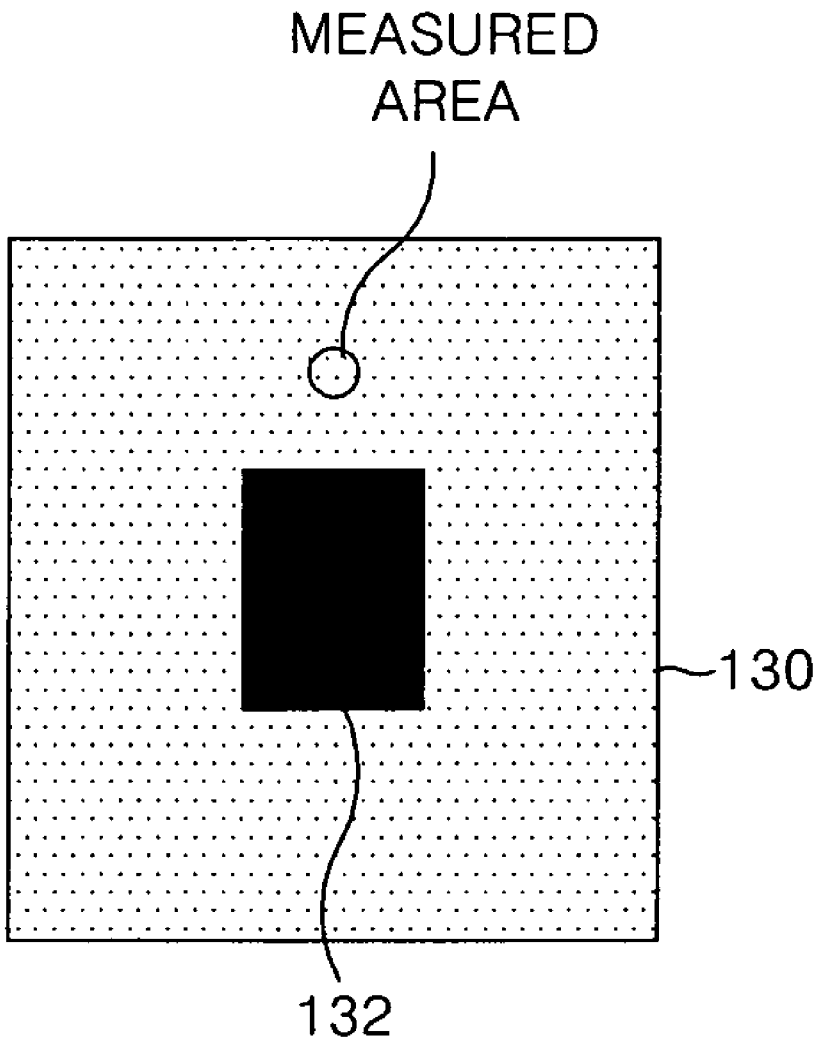
FIG. 12A depicts an exemplary arrangement for measuring a crosstalk due to a black field generated within a portion of a gray field of a liquid crystal display device.

FIG. 12A depicts an exemplary arrangement for measuring a crosstalk due to a black field generated within a portion of a gray field of a liquid crystal display device. In a first time period, a gray level is implemented across the entire field 130. Then, during a second time period, a black level is implemented in a window 132 within a portion of the gray field 130. In each of the first and second time periods, brightness is measured at a measured area.

Figure 12B:
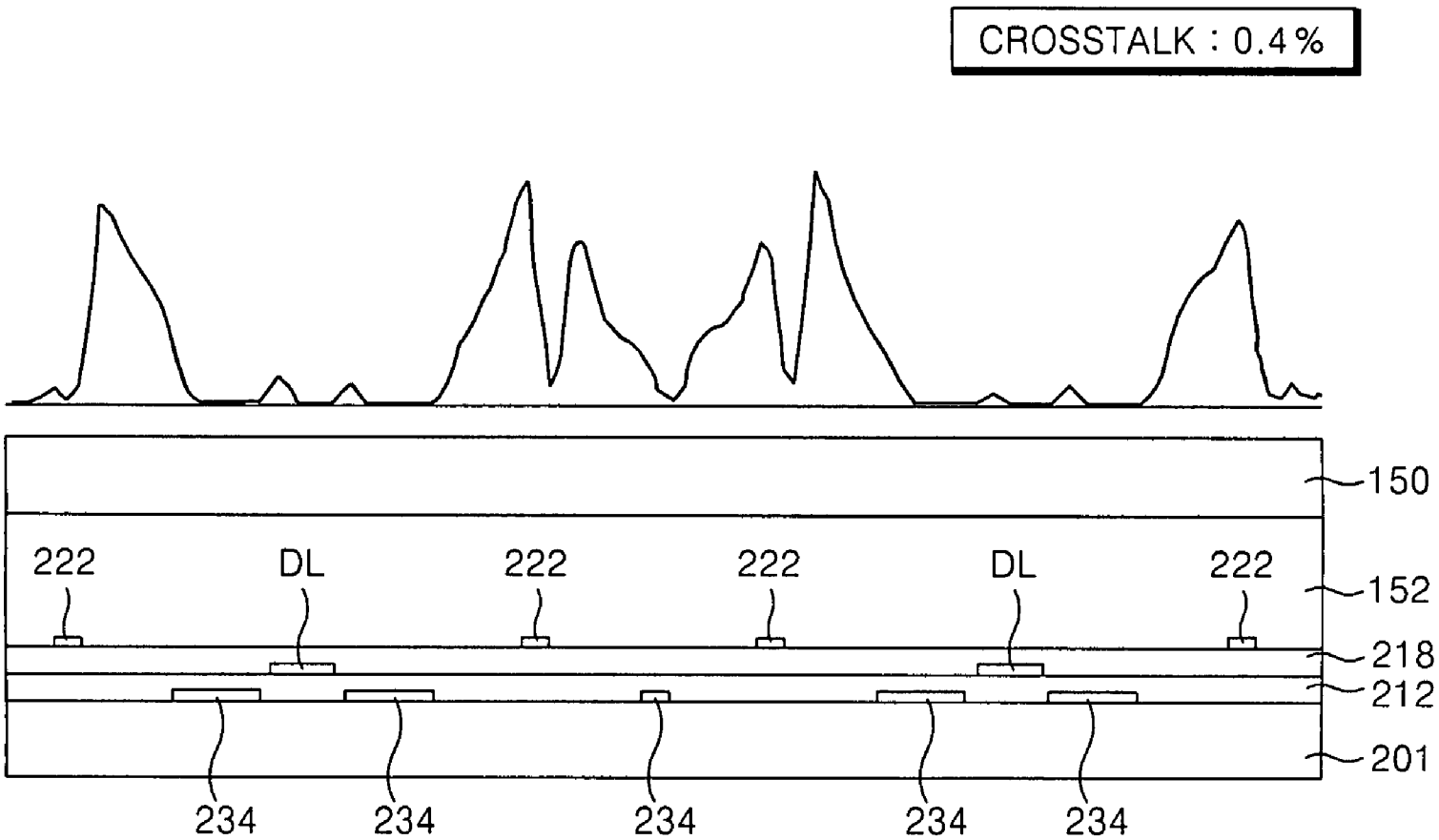
FIG. 12B shows exemplary crosstalk measurements within the liquid crystal display device of FIG. 12A, when driven by the one-dot inversion system.

FIG. 12B shows exemplary crosstalk measurements within the liquid crystal display device of FIG. 12A, when driven by the one-dot inversion system. As shown in FIG. 12B, when the liquid crystal display device is driven by the one-dot inversion system, brightness at the measured area varies by about 0.4% between the first period, when the gray level covers the entire field 130, and the second time period, when the black window 132 is generated within a portion of the gray field 130. The variation in the measured brightness is due to crosstalk between the black window 132 and the surrounding gray level in the field 130.

Figure 12C:
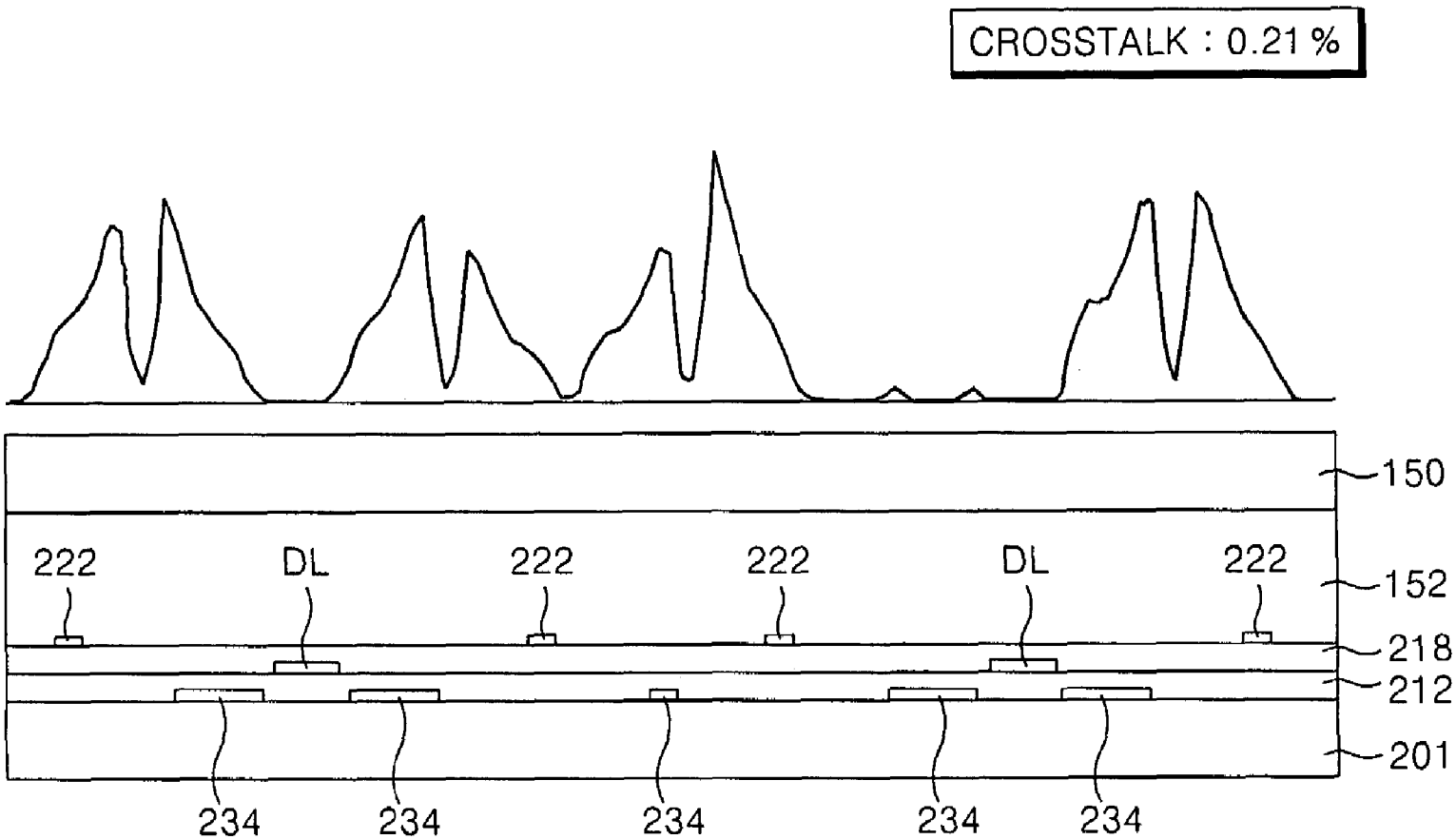
FIG. 12C shows exemplary crosstalk measurements within the liquid crystal display device of FIG. 12A, when driven by the horizontal two-dot inversion system.

FIG. 12C shows exemplary crosstalk measurements within the liquid crystal display device of FIG. 12A, when driven by the horizontal two-dot inversion system. As shown in FIG. 12C, when the liquid crystal display device is driven by the horizontal two-dot inversion system, brightness at the measured area varies by about 0.21% between the first period, when the gray level covers the entire field 130, and the second time period, when the black window 132 is generated within a portion of the field 130. Thus, crosstalk is reduced by the horizontal two-dot inversion system compared to the one-dot inversion system.

As described above, in embodiments of the present invention, the number of data lines DL1 to DLm/2 in the LCD is reduced to a half of that required by the related art LCD. Thus, the number of data drive IC's included in the data driver 22 is also reduced by a half.

As described above, in embodiments of the present invention, the liquid crystal cells positioned at odd-numbered vertical lines and the liquid crystal cells positioned at even-numbered vertical lines are alternately driven for each half-frame period. Herein, pairs of adjacent liquid crystal cells share one data line by being positioned at the left/right sides thereof. Thus, the number of data lines is reduced by about a half. Accordingly, the number of data drivers for supplying a driving signal to the data line is also reduced by a half. As a result, manufacturing cost is reduced.

Furthermore, in embodiments of the present invention, pixel voltage signals having the same polarity are applied to first and second liquid crystal cells positioned at the left and right of a shared common electrode. Accordingly, the pixel voltage signal applied to any one of the first and second liquid crystal cells can block a variation of the pixel voltage signal applied to the other liquid crystal cell.

It will be apparent to those skilled in the art that various modifications and variations can be made in the liquid crystal display device of the present invention, and the driving method thereof, without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel having a plurality of data lines;

a plurality of gate lines crossing the data lines;

first and second control lines parallel to the gate lines, the first and second control lines at opposite sides of each gate line;

first liquid crystal cells provided at one side of the data lines, respectively;

second liquid crystal cells provided at another side of the data lines, respectively;

a plurality of first switching parts that drive the first liquid crystal cells, each of the first switching parts being controlled by the second control line and the n-numbered gate line and provided at one side of a respective one of the data lines;

a plurality of second switching parts that drive the second liquid crystal cells, each of the second switching parts being controlled by the first control line and the (n+1)-numbered gate line and provided at another side of the respective one of the data lines; and a liquid crystal display panel driver that supplies pixel voltage signals having the same polarity to the first and second liquid crystal cells positioned between adjacent i-numbered data lines and (i+1)-numbered data lines, wherein one of the first liquid crystal cells and one of the second liquid crystal cells are provided between every two adjacent gate lines.

2. The liquid crystal display device of claim 1, wherein the liquid crystal display panel driver includes:

a gate driver for sequentially applying a gate signal to the gate lines during an half-frame period;

a data driver for applying the pixel voltage signals to the data lines connected to the first and second liquid crystal cells positioned between the adjacent data lines when the gate signal is applied to the gate lines; and a control signal generator for alternately supplying control signals to the first and second control lines during each half-frame period.

3. The liquid crystal display device of claim 2, wherein the first switching part includes:

a first thin film transistor connected to the n-numbered gate line and the data line; and a second thin film transistor connected between the first thin film transistor and the first liquid crystal cell, wherein the first thin film transistor applies the pixel voltage signal from the data line to the second thin film transistor in response to a gate signal on the gate line, and the second thin film transistor applies the pixel voltage signal to the first liquid crystal cell in response to the control signal applied to the second control line.

4. The liquid crystal display device of claim 2, wherein the second switching part includes:

a third thin film transistor connected to the (n+1)-numbered gate line, the third thin film transistor being turned on when the gate signal is applied, and the third thin film transistor receiving the pixel voltage signal; and a fourth thin film transistor being turned on when the control signal is applied to the first control line to apply, the fourth thin film transistor applying the pixel voltage signal to the second liquid crystal cell.

5. The liquid crystal display device of claim 4, wherein the first liquid crystal cell has a first pixel electrode connected to the second thin film transistor, and a common electrode for generating an horizontal electric field along with the first pixel electrode; and the second liquid crystal cell has a second pixel electrode connected to the fourth thin film transistor, and a second common electrode for generating the horizontal electric field along the second pixel electrode.

6. The liquid crystal display device of claim 3, wherein the first liquid crystal cell has a first pixel electrode connected to the second thin film transistor, and a common electrode for generating an horizontal electric field along with the first pixel electrode; and the second liquid crystal cell has a second pixel electrode connected to the fourth thin film transistor, and a second common electrode for generating the horizontal electric field along the second pixel electrode.

7. The liquid crystal display device of claim 2, wherein the first and second liquid crystal cells receive the pixel voltage signals alternately for each half-frame period in response to the control signals being applied alternately for each half-frame period.

8. The liquid crystal display device of claim 1, further comprising:

a shared common electrode positioned between the first and second liquid crystal cells, the first and second liquid crystal cells sharing the shared common electrode, and pixel voltage signals having the same polarity are applied to the first and second liquid crystal cells positioned at opposite sides of the shared common electrode.

9. The liquid crystal display device of claim 1, wherein the liquid crystal display panel driver supplies pixel signals to the first and second liquid crystal cells through an horizontal two-dot inversion system, in which polarity is inverted for each two dot unit in a horizontal direction while being inverted for each one dot unit in a vertical direction.

10. A method of driving a liquid crystal display device including a liquid crystal display panel having a plurality of data lines, a plurality of gate lines crossing the data lines, first and second control lines being parallel to the gate lines, wherein the first and second control lines are provided at opposite sides of each gate line, first liquid crystal cells provided at one side of the data lines, respectively, second liquid crystal cells provided at another side of the data lines, respectively, a plurality of first switching parts provided at one side of a respective one of the data lines for driving the first liquid crystal cells under control of the second control line and the n-numbered gate line, and a plurality of second switching parts provided at another side of the respective one of the data lines for driving the second liquid crystal cells under control of the first control line and the (n+1)-numbered gate line, the method comprising the steps of:

supplying first pixel signals to the first liquid crystal cells during a first half-frame period; and supplying second pixel signals to the second liquid crystal cells during a second half-frame period, the second pixel signals having the same polarity as the first pixel signals.

11. The method of claim 10, wherein supplying the second pixel signals to the second liquid crystal cells includes:

supplying a first control signal via the first control line to turn on a fourth thin film transistor, the fourth thin film transistor being included in the second switching part and connected to the second liquid crystal cells;

sequentially supplying a gate signal to each of the gate lines to turn on a third thin film transistor included in the second switching part; and supplying the second pixel signals with a polarity different from that of the first pixel signal to the second liquid crystal cells connected to the same data line as the first liquid crystal cells when the gate signal is applied.

12. The method of claim 11, wherein the first and second control signals are alternately applied during each half-frame period.

13. A thin film transistor array substrate for a liquid crystal display panel, comprising:

a plurality of gate lines provided on a lower substrate;

first and second control lines positioned at opposite sides of each of the plurality of the gate lines;

data lines crossing the first and second control lines;

first and second liquid crystal cells alternately provided at each crossing of the gate lines and the data lines;

a plurality of first switching parts for driving the first liquid crystal cells, each of the first switching parts being controlled by the second control line and the n-numbered gate line and provided at a right side of a respective one of the data lines;

a plurality of second switching parts for driving the second liquid crystal cells, each of the second switching parts being controlled by the first control line and the (n+1)-numbered gate line and provided at a left side of the respective one of the data lines; and means for supplying a first pixel voltage signal to the first liquid crystal cells, and a second pixel voltage signal to the second liquid crystal cells, the first pixel voltage signal and the second voltage signal having same polarity, wherein one of the first liquid crystal cells and one of the second liquid crystal cells are provided between every two adjacent gate lines.

* * * * *